US005660614A

United States Patent [19]

Waite et al.

[11] Patent Number: 5,660,614

[45] Date of Patent: *Aug. 26, 1997

[54] GAS TREATMENT OF MOLTEN METALS

[75] Inventors: Peter D. Waite, Chicoutimi; Serge Eugene Lavoie, Jonquiere; Ghyslain Dube, Chicoutimi; Robert Dumont, Cap de la Medeleine, all of Canada

[73] Assignee: Alcan International Limited, Montreal, Canada

[ * ] Notice: The term of this patent shall not extend beyond the expiration date of Pat. No. 5,527,381.

[21] Appl. No.: 462,011

[22] Filed: Jun. 5, 1995

Related U.S. Application Data

[63] Continuation-in-part of Ser. No. 191,635, Feb. 4, 1994, Pat. No. 5,527,381.

[51] Int. Cl.[6] ..... C22B 21/06

[52] U.S. Cl. ..... 75/680; 75/681; 75/708

[58] Field of Search ..... 75/680, 681, 708

[56] References Cited

U.S. PATENT DOCUMENTS

| | | | |
|---|---|---|---|
| 3,573,895 | 4/1971 | Ostberg . | |
| 3,917,242 | 11/1975 | Bass et al. . | |
| 4,290,590 | 9/1981 | Montgrain . | |
| 4,372,541 | 2/1983 | Bocourt et al. . | |
| 5,160,693 | 11/1992 | Eckert et al. . | |
| 5,527,381 | 6/1996 | Waite et al. | 75/708 |

FOREIGN PATENT DOCUMENTS

| | | |
|---|---|---|
| 0073729 | 3/1983 | European Pat. Off. . |
| 0077282 | 4/1983 | European Pat. Off. . |
| 0225935 | 6/1987 | European Pat. Off. . |
| 0151434 | 12/1989 | European Pat. Off. . |
| 2160720 | 7/1973 | France . |
| 2419123 | 10/1979 | France . |
| WO8606749 | 11/1986 | WIPO . |

OTHER PUBLICATIONS

332 Giesseri, vol. 81, No. 14, Jul. 1994 Dusseldorf, DE. pp. 478–483, XP 000457409. *Reinigung von Aluminiumium-schmelzen* by Wolfgang Schneider of Bonn, pp. 479–480—Translation only.

*The Use of Rotating–Impeller Gas Injection in Aluminum Processing*, Christophe Leroy and Gerard Pignault, *JOM*, 43(1991) Sep., No. 9, Warrendale, PA, USA.

*Primary Examiner*—Melvyn Andrews
*Attorney, Agent, or Firm*—Cooper & Dunham LLP

[57] ABSTRACT

A method of and apparatus for treating molten metal to achieve effective removal of such unwanted inclusions as gases, alkali metals, entrained solids, and the like. The method comprises continuously introducing molten metal into a container forming a trough or trough section, such as the trough provided between a melting furnace and a casting machine, providing at least one mechanically movable gas dispenser submerged within the metal in the container and introducing a gas into the metal adjacent to the gas disperser in a part of the trough forming a treatment zone such that the gas is broken into smaller bubbles by the gas dispenser and dispersed through the treatment zone. The trough or trough section is such that it exhibits a static to dynamic metal holdup of less than 50%.

10 Claims, 16 Drawing Sheets

GAS TREATMENT OF MOLTEN METALS

CROSS-REFERENCE TO RELATED APPLICATION

This application is a continuation-in-part of application Ser. No. 191,635 filed Feb. 4, 1994 now U.S. Pat. No. 5,527,381.

BACKGROUND OF THE INVENTION

I. Field of the Invention

This invention relates to a method and apparatus for the treatment of molten metals with a gas prior to casting or other processes involving metal cooling and solidification. More particularly, the invention relates to the treatment of molten metals in this way to remove dissolved gases (particularly hydrogen), non-metallic solid inclusions and unwanted metallic impurities prior to cooling and solidification of the metal.

II. Description of the Prior Art

When many molten metals are used for casting and similar processes they must be subjected to a preliminary treatment to remove unwanted components that may adversely affect the physical or chemical properties of the resulting cast product. For example, molten aluminum and aluminum alloys derived from alumina reduction cells or metal holding furnaces usually contain dissolved hydrogen, solid non-metallic inclusions (e.g. $TiB_2$, aluminum/magnesium oxides, aluminum carbides, etc.) and various reactive elements (e.g. alkali and alkaline earth metals). The dissolved hydrogen comes out of solution as the metal cools and forms unwanted porosity in the product. Non-metallic solid inclusions reduce metal cleanliness and the reactive elements and inclusions create unwanted metal characteristics.

These undesirable components are normally removed from molten metals by introducing a gas below the metal surface by means of gas injectors. As the resulting gas bubbles rise through the mass of molten metal, they adsorb gases dissolved in the metal and remove them from the melt. In addition, non-metallic solid particles are swept to the surface by a flotation effect created by the bubbles and can be skimmed off. If the gas used for this purpose is reactive with contained metallic impurities, the elements may be converted to compounds by chemical reaction and removed from the melt in the same way as the contained solids or by liquid-liquid separation.

This process is often referred to as "metal degassing", although it will be appreciated from the above description that it may be used for more than just degassing metals. The process is typically carried out in one of two ways: in the furnace, normally using one or more static gas injection tubes; or in-line, by passing the metal through a box situated in the trough normally provided between a holding furnace and the casting machine so that more effective gas injectors can be used. In the first case, the process is inefficient and time consuming because large gas bubbles are generated, leading to poor gas/metal contact, poor metal stirring and high surface turbulence and splashing. Dross formation and metal loss result from the resulting surface turbulence, and poor metal stirring results in some untreated metal. The second method (as used in various currently available units) is more effective at introducing and using the gas. This is in part because the in-line method operates as a continuous process rather than a batch process.

For in-line treatments to work efficiently, the gas bubbles must be in contact with the melt for a suitable period of time and this is achieved by providing a suitable depth of molten metal above the point of injection of the gas and by providing a means of breaking up the gas into smaller bubbles and dispersing the smaller bubbles more effectively through the volume of the metal, for example by means of rotating dispersers or other mechanical or non-mechanical devices. Residence times in excess of 200 seconds and often in excess of 300 seconds are required in degassers of this type to achieve adequate results. Effectiveness is frequently defined in terms of the hydrogen degassing reaction for aluminum alloys and an adequate reaction is generally considered to be at least 50% hydrogen removal (typically 50 to 60%). This results in the need for deep treatment boxes of large volume (often holding three or more tons of metal) which are unfortunately not self-draining when the metal treatment process is terminated. This in turn gives rise to operational problems and the generation of waste because metal remains in the treatment boxes when the casting process is stopped for any reason and solidifies in the boxes if not removed or kept molten by heaters. Moreover, if the metals or alloys being treated are changed from time to time, the reservoir of a former metal or alloy in a box (unless it can be tipped and emptied) undesirably affects the composition of the next metal or alloy passed through the box until the reservoir of the former metal is depleted. Various conventional treatment boxes are in use, but these require bulky and expensive equipment to overcome these problems, e.g. by making tie box tiltable to remove the metal and/or by providing heaters to keep the metal molten. As a consequence, the conventional equipment is expensive and occupies considerable space in the metal treatment facility. Processes and equipment of this type are described, for example, in U.S. Pat. Nos. 3,839,019 and 3,849,119 to Bruno et al; U.S. Pat. Nos. 3,743,263 and 3,870,511 to Szekeley; U.S. Pat. No. 4,426,068 to Gimond et al; and U.S. Pat. No. 4,443,004 to Hicter et al. Modern degassers of this type generally use less than one litre of gas per kilogram (Kg) of metal treated. In spite of extensive development of dispersers to achieve greater mixing efficiency, such equipment remains large, with metal contents of at least 0.4 $m^3$ and frequently 1.5 $m^3$ or more being required. One or more dispersers such as the rotary dispersers previously mentioned may be used, but for effective degassing, at least 0.4 $m^3$ of metal must surround each disperser during operation.

To avoid problems associated with deep treatment boxes, there have been a number of attempts at metal treatment in shallow vessels such as the trough normally provided between a metal holding furnace and a casting machine. This would provide a vessel which could drain completely after use and thus avoid some of the problems associated with the deep box treatment units. The difficulty is that this would inevitably require a reduction of the metal depth above the point of gas injection while still allowing for effective gas/metal contact times. The use of gas diffusion plates or similar devices in the bottom of such shallow vessels or troughs has been proposed to introduce the gas and create the desired gas/metal contact. These are described, for example, in U.S. Pat. No. 4,290,590 to Montgrain and U.S. Pat. No. 47,714,494 to Eckert. However, bubbles produced in this way still tend to be too large and, given the reduced metal depth, such vessels or troughs necessarily must be made undesirably long to achieve effective degassing, and the volume of gas introduced must be made quite high (typically over 2 litres/Kg). As a result, the apparatus takes up a lot of floor space and the volume of gas introduced creates a risk of chilling the metal so that it may be necessary to provide compensating heaters. Such trough degassers can be drained, but because of large bubble size they still require long residence times to effectively treat metal to the same degree of efficiency as obtained with other in-line methods. In addition, the introduction of large gas bubbles into a shallow metal volume results in excess surface turbulence and splashing. As a result, degassing in shallow troughs is not generally carried out on an industrial scale.

Thus there is a need for a metal treatment method and apparatus that provides effective treatment in short time periods, with correspondingly small volumes of metal, and with low gas consumption. Such processes and equipment would then be able to be carried out in metal delivery troughs with all the advantages of such devices that were noted above, but without the problems of high gas consumption or the space limitations noted.

OBJECTS OF THE INVENTION

An object of the invention is to enable gas treatment of molten metal to be carried out effectively in short time periods and correspondingly small volumes, using relatively low amounts of treatment gas.

Another object of the invention is to provide a method and apparatus for gas treatment of molten metal that can be carried out in small volumes of metal, and in particular in metal within metal delivery troughs or similar devices.

Another object of the invention is to provide a mechanical gas injection system that operates within a small volume of metal, such as found in a metal delivery trough or similar device to achieve effective gas treatment.

Another object of the invention, at least in its preferred aspects, is to provide a method and apparatus for gas treatment of molten metal that allows the metal to be drained substantially completely from the treatment zone after treatment is complete.

Yet another object of the invention is to provide a method and apparatus for gas treatment of molten metal that avoids the need for metal heaters and bulky equipment.

These and other objects and advantages of the present invention will be apparent from the following disclosure.

SUMMARY OF THE INVENTION

It has now surprisingly been found that it is possible to operate gas injectors in such containers, e.g. shallow troughs. In particular rotary gas injectors that generate a radial and horizontal flow of metal and operate at a rotational velocity sufficient to shear the gas bubbles are effective in such applications.

Thus, according to one aspect of the invention, there is provided a method of treating a molten metal with a treatment gas, comprising: introducing the molten metal into a container having a bottom wall and opposed side walls; providing at least one mechanically movable gas injector within the metal in the container; and injecting a gas into the metal in a part of the container forming a treatment zone via said at least one injector to form gas bubbles in the metal while moving said at least one injector mechanically to minimize bubble size and maximize distribution of said gas within said metal.

According to another aspect of the invention, there is provided apparatus for treating a molten metal with a treatment gas, comprising: a container having a bottom wall and opposed side walls for holding and conveying said molten metal; at least one gas injector in use positioned in said container submerged in said metal; means for rotating said gas injector about a central vertical axis thereof; and means for conveying gas to said injector for injection into said metal.

According to another aspect of the invention, there is provided an injector for injecting gas into a molten metal, comprising: rotor having a cylindrical side surface and a bottom surface; a plurality of openings in said side surface spaced symmetrically around the rotor, at least one opening in the bottom surface, and at least one internal passageway for gas delivery and an internal structure for interconnecting said openings in said side surface, said openings in said bottom surface and said at least one internal passageway; said internal structure being adapted to cause gas bubbles emanating from said internal passageway to break up into finer bubbles and to cause a metal/gas mixture to issue from said openings in said side surface in a generally horizontal and radial manner.

According to another aspect of the invention there is provided a method for treating a molten metal with a treatment gas, comprising: continuously introducing the molten metal into a container having a bottom wall and opposed side walls which form a section of a trough; providing at least one mechanically moveable gas disperser within the metal in the container; injecting a gas into the metal adjacent to said gas disperser in a part of said trough forming a treatment zone such that said gas is broken into smaller bubbles by said gas disperser and is dispersed through the treatment zone; said trough section being such that said section exhibits a static to dynamic metal holdup of less than about 50%.

According to yet another aspect of the invention there is provided an apparatus for treating molten metal with a treatment gas; comprising: a container having a bottom wall and opposed side walls forming a trough for conveying said molten metal; at least one gas disperser in use positioned in said container submerged in said metal; means for moving said disperser mechanically in a motion selected from the group consisting of rotation about a central vertical axis, oscillation, or vibration; at least one gas injector located adjacent to said at least one gas disperser; and means for conveying gas to said at least one injector for injection into said metal.

It is a surprising and unexpected feature of this invention that it is possible to operate gas dispensers or injectors in such a way as to disperse gas to generate the required gas holdup and gas-metal surface area within the constraints of the treatment segment, and further within a trough section. Prior art degasser methods generally do not achieve the high values of gas holdup and gas-metal surface area characteristic of the present invention. Furthermore, to maximize performance, prior art methods have relied on shear generation and mixing methods that have produced substantial splashing and turbulence which has required operation using treatment segments of significantly larger volume than the present invention. They therefore could not achieve the overall objective of effective degassing in short time periods.

The present invention makes it possible to treat a molten metal with a gas using a preferably rotary gas injector or dispenser while providing only a relatively small depth of metal above the point of injection of the gas and consequently permits effective treatment of metals contained in small vessels and, in particular, in metal delivery troughs typically used to deliver metal from a holding furnace to a casting machine. Such metal delivery troughs are generally open ended refractory lined sections and, although they can vary greatly in size, are generally about 15 to 50 cm deep and about 10 to 40 cm wide. They can generally be designed to drain completely when the metal supply is interrupted.

The invention, at least in its preferred forms, makes it possible to achieve gas treatment efficiencies, as measured by hydrogen removal from aluminum alloys, of at least 50% using less than one litre of treatment gas per Kg of metal, and to achieve reaction times of between 20 and 90 seconds, and often between 20 and 70 seconds.

In a preferred form of the invention, a metal treatment zone is provided within a metal delivery trough containing one or more generally cylindrical, rapidly rotating gas injection rotors, having at least one opening on the bottom, at least three openings symmetrically placed around the sides, and internal structure such that the bottom openings and side openings are connected by means of passages formed by the internal structure wherein molten metal can freely move; at least one gas injection port communicating with the passageway in the internal structure for injection of treatment gas into metal within the internal structure; wherein the internal structure causes the treatment gas to be broken into bubbles and mixed within the metal within the internal structure, and further causes the metal-gas mixture to flow from the side openings in a radial and substantially horizontal direction. It is further preferred that each rotor have a substantially uniform, continuous cylindrical side surface except in the positions where side openings are located, and that the top surface be closed and in the form of a continuous flat or frusto-conical upwardly tapered surface the top surface and side surfaces thereby meeting at an upper shoulder location. It is further preferred that the side openings on the surface sweep an area, when the rotor is rotated, such that the area of the openings in the side surface is no greater than 60% of the swept area.

It is further preferred that the rotors be rotated at a high speed sufficient to shear the gas bubbles in the radial and horizontal streams into finer bubbles, and in particular that the rotational speed be sufficient that the tangential velocity at the surface of the rotors be at least 2 metres/sec at the location of the side openings. Each rotor must be located in specific geometric relationship to the trough, and preferably with the upper shoulder of the rotor located at least 3 cm below the surface of the metal in the trough, and the bottom surface located at least 0.5 cm from the bottom surface of the trough. There is also defined a treatment segment surrounding the rotor with a volume defined by a length along the trough equal to the distance between the trough walls at the metal surface, and a vertical cross-sectional area equal to the vertical cross sectional area of the metal contained within the trough at the midpoint of the rotor. In some configurations, gas injectors, such as rotors, may be located sufficiently close together that the distance between the centres of the injectors is less than the distance between the trough walls at the midpoint of the injector. Therefore, the treatment segment volume may be further defined as the volume defined by the vertical cross-sectional area of the metal contained within the trough at the midpoint of the gas injector multiplied by the smaller of the distance between the trough walls at the metal surface and the distance between the centres of adjacent gas injectors. The volume of the treatment segment is assumed to include the volume of the immersed portion of the injector itself upon which the volume is defined. The rotor and trough are further related by the requirement that the volume of metal within the treatment segment must not exceed 0.20 $m^3$, and most preferably not exceed 0.07 $m^3$. The treatment segment volume should, however, preferably be at least 0.01 $m^3$ for proper operation.

When used to treat aluminum and its alloys, the treatment segment is limited by the equivalent relationship that the amount of aluminum or aluminum alloy contained within the treatment segment must not exceed 470 Kg and most preferably not exceed 165 Kg.

In the preceding description, the mechanically moveable gas injector preferably provides three functions, namely introduction of treatment gas, break up of the treatment gas into fine bubbles, and the dispersion of the treatment gas bubbles. It is possible to separate the introduction process from the remaining two functions and still provide metal treatment in the trough sections that are a feature of this invention. In this process gas bubbles are generated in the molten metal by one or more fixed gas dispensers, and the mechanically moveable gas injector becomes a mechanically moveable gas disperser, providing the functions of break up of gas bubbles and dispersion of the gas bubbles into the surrounding metal. The gas dispersers and gas dispensers act together to perform the function of gas introduction as described above, and operate together with the vessel or trough used to contain the metal, to perform the same metal treatment functions as previously described.

Thus one has a method for treating molten metal with a treatment gas, comprising continuously introducing the molten metal into a container having a bottom wall and opposed side walls which form a section of a trough; providing at least one mechanically moveable gas disperser within the metal in the container; introducing said treatment gas in the form of bubbles into the metal adjacent to said gas disperser in a part of said trough forming a treatment zone such that said gas is broken into smaller bubbles by said gas disperser and is dispersed through the treatment zone; said trough section being such that said section exhibits a static to dynamic metal holdup of less than about 50%.

One similarly has an apparatus for treating molten metal with a treatment gas; comprising a container having a bottom wall and opposed side walls forming a trough for conveying said molten metal; at least one gas disperser in use positioned in said container submerged in said metal; means for moving said disperser mechanically in a motion selected from the group consisting of rotation about a central vertical axis, oscillation, or vibration; at least one gas dispenser located adjacent to said at least one gas disperser; and means for conveying gas to said at least one dispenser for introduction into said metal.

It is preferred that the gas introduction take place via one or more fixed gas dispensers with gas outlets below the gas disperser so that gas bubbles formed by the fixed gas dispenser rise in the metal and contact the mechanically moveable gas disperser. The gas dispensers can be in the form of one or more porous elements in the bottom wall of the trough and connected to a source of treatment gas. The gas dispensers may also be in the form of one or more tubes mounted in the bottom wall and connected to a source of treatment gas. The gas dispensers may further be in the form of one or more tubes mounted above the metal level in the trough and extending down into the metal, terminating in a outlet below the gas disperser and connected at the upper end to a source of treatment gas. It is preferred that there be one gas dispenser, with its outlet located below each gas disperser so that the treatment gas bubbles upwards and contacts or is drawn into the gas disperser where it is efficiently broken into smaller bubbles and dispersed through the metal in the treatment zone.

where gas dispensers are mounted in the bottom wall of the trough, it is particularly convenient that the trough section have substantially zero static to dynamic metal holdup to avoid blockage of the gas dispensers by metal remaining in the trough between casts.

Because the gas bubble break up and dispersion of this invention can take place in a shallow trough of the type used in transferring molten metal, it is possible to use such a preferred configuration.

The fixed gas dispensers can also be advantageously used with mechanically moveable gas dispersers having all three functions of gas introduction, bubble breakup and dispersion of bubbles thereby being functionally the same as the mechanically movable gas injectors previously described. The combination permits treatment gas to be introduced in two ways rather than solely by the mechanically moveable gas injector as previously described. It further permits the use of different treatment gas mixtures in the two introduction means. This is advantageous in permitting a reactive gas to be introduced through one means as a portion of the treatment gas mixture, and an inert gas to be used in the other injection means.

The use of a fixed, but adjacent gas dispenser with the gas disperser permits the effectiveness of bubble breakup and dispersion to be altered by varying the relative location of the two devices. Thus where one treatment gas mixture requires less fine bubbles to be dispersed, introduction via the fixed adjacent dispensers may be advantageous.

The gas disperser can be any of the mechanically moveable devices of this invention, but it is particularly preferred that it be in the form of a rotary device, and such devices can be in every way identical to devices used as integral gas introduction and bubble breaking and dispersion devices, except that a means of conveying gas may be omitted unless specifically required as one of the above options.

In operation, gas bubbles generated by the fixed gas dispensers are entrained in the molten metal and come in contact with the gas disperser where they are broken up and dispersed. In the case of the preferred rotary gas dispersers, the action of the disperser assists by drawing the metal into the disperser along with the entrained gas bubbles.

The volume limitations expressed for the treatment segment create a hydrodynamic constraint on the container plus gas injectors of this invention. The container as described above may take any form consistent with such constraints but most often takes the form of a trough section or channel section. Most conveniently this trough section will have the same cross-sectional dimensions as a metallurgical trough used to convey molten metal from the melting furnace to the casting machine, but where conditions warrant, the trough may have different depths or widths than the rest of the metallurgical trough system in use. To ensure that the rotor is also in proper geometric relationship to the trough even when deeper trough sections are used, the trough depth must be limited, and this limitation may be measured by the ratio of static to dynamic metal holdup. The dynamic metal holdup is defined as the amount of metal in the treatment zone when the gas injectors are in operation, while the static metal holdup is defined as the amount of metal that remains in the treatment zone when the source of metal has been removed and the metal is allowed to drain naturally from the treatment zone. For the desired operation the static to dynamic metal holdup should not exceed 50%. From other considerations, it is also clear that residual metal left in the trough should preferably be minimized to meet all the objectives of the invention, and therefore it is particularly preferred that the static to dynamic metal holdup be approximately zero. Where practical situations require that a non-zero ratio of static to dynamic holdup be used, it is preferred that the ratio not exceed 35%, which permits the residual metal to solidify between casts and permits relatively easy manual removal of the residue. It is most convenient that the trough have opposed sides that are straight and parallel, but other geometries, for example curved side walls, may also be used in opposition to each other.

The treatment segment defines the number of gas injectors required to effectively meet the object of the invention, once the volume flowrate of metal to be treated is known. It is surprising that although the total size of the treatment zone may be substantially less in the present invention than in prior art in-line degassers, the number of gas injectors required may actually be higher in certain circumstances. The treatment segment volume divided by the volume flowrate of metal to be treated should be less than 70 seconds It is preferably less than 35 seconds to ensure that all the metal volume is close enough to the gas injector to ensure that the effect of gas injection is felt throughout the metal volume during the time the metal is near the injector. Treatment of metal that is flowing at a high flowrate will require a larger treatment volume, within the limits already given, than metal flowing at low flowrates. Flowrates typically fall within the range of about 0.0005 to 0.007 cubic metres per second, but may be higher or lower, if desired.

The gas injectors preferably operate with a high specific gas injection rate so that the number of injectors required to achieve effective treatment is acceptably low. The specific gas injection rate is defined as the rate of gas injection via a gas injector divided by the treatment segment volume associated with that injector. For proper degassing by the process of this invention, a specific gas injection rate of at least 800, and more preferably at least 1000, litres of gas/minute/cubic metre of metal is preferred. Because the overall metal treatment operates within normal metallurgical requirements (less than 2345 litre gas/$m^3$ of metal treated, equivalent to 1 litre gas/kg of aluminum for example, and more typically between 940 and 1640 litres/$m^3$) such higher specific gas injection rates ensure that degassing can be accomplished generally with 10 injectors or less and frequently with fewer than 8 injectors.

The above embodiment may achieve a gas holdup, measured as the change in volume of the metal-gas mixture within a treatment segment with treatment gas added via the gas injection port at a rate of less than 1 litre/Kg, compared to the volume with no treatment gas flowing, of at least 5% and preferably at least 10%.

It is most preferred that the rotor have an internal structure consisting of vanes or indentations and that the side openings be rectangular in shape, formed by the open spaces between the vanes or indentations, and extending to the bottom of the rotor to be continuous with the bottom openings. The rotor as thus described preferably has a diameter of between 5 cm and 20 cm, preferably between 7.5 cm and 15 cm, and is preferably rotated at a speed of between 500 and 1200 rpm, and more preferably between 500 and 850 rpm.

Although various explanations for this invention are possible, the following is at present believed to describe the complex series of interactions necessary for the invention to meet the objective of efficient metal treatment in short time periods.

Conventional degassers of the deep box type or trough diffuser type, for example, all require substantially longer reaction times to achieve effective reaction (such as degassing). The key feature of this invention is the means of generating high gas holdup within the metal in the treatment zone by means of using gas injectors providing mechanical motion within a defined volume of metal per injector. Because a high gas holdup is generally believed to be a result of fine bubbles dispersed throughout the metal with little coalescence, this means that the surface area of the gas in contact with the metal in a high gas holdup situation is substantially increased, and therefore, according to normal chemical principles, reaction can occur in shorter times. Gas bubble size cannot be readily measured in molten metal systems. Gas bubble sizes based on water models are not reliable because of surface tension and other differences. It is possible to estimate gas-metal surface area for a particular degassing apparatus, and by applying further assumptions to estimate gas bubble sizes.

The measurement of gas-metal surface areas can be determined from the work of Sigworth and Engh, "Chemical and Kinetic Factors Related to Hydrogen Removal from Aluminum", Metallurgical Transactions B, American Society for Metals and The Metallurgical Society of AIME, Volume 13B, September 1982, pp 447–460 (the disclosure of which is incorporated herein by reference). The effect of alloy composition on hydrogen solubility was determined based on the method disclosed in Dupuis, et. al., "An analysis of Factors Affecting the Response of Hydrogen Determination Techniques for Aluminum Alloys", Light Metals 1992, The Minerals, Metals & Materials Society of AIME, 1991, pp 1055–1067 (also incorporated herein by reference).

Basically, in order to measure gas-metal surface area, the inlet and outlet hydrogen concentrations of the metal passing through the degasser are measured (for example using Commercial Units such as Alscan or Telegas (trade names)) and the metal flow rate, the metal temperature, the alloy composition and the gas flow rate per rotor are noted. The hydrogen solubility in the specific alloy is then calculated as a function of temperature. Sigworth & Engh's hydrogen balance equations for a continuous reactor (equations 35 and 36, page 451, Sigworth & Engh) are solved simultaneously for each rotor of the degasser. Based on the known operating parameters and measured hydrogen removal, the gas metal contact area is obtained from the previous step. Based on this method, the present invention requires operation with a gas-metal surface area of at least 30 $m^2/m^3$ of metal within a treatment segment in order to achieve the desired degassing efficiency in short reaction times. Prior art degassers generally operate with gas-metal interfacial surface areas of less than 10 $m^2/m^3$.

The total interfacial contact area can then be used to "estimate" the volume average equivalent spherical gas bubble diameter produced by the gas injection rotor based on the following assumptions:

1) the gas bubbles are all of the same diameter;
2) the gas bubbles are all spherical;
3) the gas bubbles rise to the liquid metal surface vertically from the depth of gas injection;
4) the gas bubbles ascend through the metal at their terminal rise velocity (calculated using correlations for gas bubbles in water, e.g. according to Szekely, "Fluid Flow Phenomina in Metals Processing", Academic Press, 1979; incorporated herein by reference).

Finally, the volume average equivalent spherical gas bubble diameter is calculated using the equation:

$$A = \frac{3 \cdot Q \cdot h_o}{R \cdot U_t}$$

wherein:

Q=volumetric gas flow rate taking into account thermal expansion $h_o$=depth of gas injection $U_t$=thermal rise velocity of gas bubbles and R=spherical gas bubble radius.

Based on this method of estimation, gas bubble sizes are 2 to 3 times smaller in the present invention than expected in systems of the deep box type, and there are fewer large bubbles present, thus supporting the explanation of the effectiveness of the present invention.

By associating a gas injector with a defined volume of molten metal (the "treatment segment" volume) that the fine gas bubbles generated by the mechanical motion are properly dispersed fully through the treatment zone and therefore the requirement to achieve high gas holdup is met. It should be noted that although the total volumes of metal within a treatment zone of the present invention are substantially reduced over those in a deep box degasser for example because of reduced reaction time requirements, the number of gas injectors may at the same time be increased because of the above requirements of the treatment segment.

Without wishing to be limited to any particular theory, the following is one explanation of the operation of this invention. The gas injectors within each treatment segment balance a number of requirements. The injectors generate a sufficient metal flow momentum in the streams of gas-containing metal to carry the metal and gas throughout the treatment segment but without impinging on container sides or bottom in such a way as to cause bubbles to coalesce or metal to splash. Bubble coalescence at the sides or bottom of the container will be manifested by a non-uniformity of the distribution of bubbles breaking the surface of the metal in the treatment segment, and such coalescence indicates that the average bubble size has been increased and will therefore, according to the above explanation, result in reduced gas holdup and poorer performance.

In the preferred embodiment of rotary gas injectors operating within a trough and where the rotary gas injectors have side openings, bottom opening and internal structure, the flow momentum is generated in a radial direction to achieve the distribution of gas bubbles required above and this momentum is created by the rotational motion of the injector. The rotary gas injector further operates to generate the fine bubbles of high gas-metal surface area characteristic of one aspect of the invention by generating a surface tangential velocity which in turn depends on the diameter of the rotary injector. It can be appreciated therefore that although rotors can be devised to operate over a wide range of rotational speeds, the optimum performance of a rotary gas injector of this invention within the constraints of its relationship to the trough will result in a relatively narrow range of rotational speeds within which it can operate at maximum effectiveness. The user will adjust the rotational speed to achieve the desired operational results.

While a rapidly rotating gas injector represents a preferred embodiment of the invention, such injectors can generate substantial deep vortices (extending down to the rotor itself) in the metal surface when operated in small volumes of metal. This undesirable effect can be reduced by ensuring that all external surfaces of the rotor are as smooth as possible, with no projections, etc., that might increase drag and form a vortex. However, such smooth surfaces are generally poorer at creating the shear necessary to generate fine gas bubbles, and it is only by balancing the geometry of the rotor with the operating speed and the trough configuration that sufficient shear and metal circulation, with no vortex formation, can be achieved. It has further been found that the bubble dispersing and turbulence and deep vortex reducing features of rotary gas dispersers of this invention are improved by the presence of a directed metal flow within the metal surrounding the rotary gas injectors. Such a directed metal flow is obtained, for example, when the metal flows along a trough, such as a metal delivery trough as described in this disclosure.

Directed metal flows of this type have surprisingly also been found to reduce any residual vortex formation in spite of the relatively low metal velocity compared to the tangential velocity of the rotary gas injector. The presence of flow directing means within the trough which direct the principal flow counter to the direction of the tangential velocity component in the metal introduced by the rotary gas injector are particularly useful.

The presence of directed metal flow changes the momentum vector of the radial metal flow to an extent that the flow direction overall is more longitudinal and the problems associated with impingement on an adjacent trough wall are substantially reduced. The magnitude of the directed metal flow clearly impacts on this effect.

In deep box treatment vessels using rotary gas dispersers, the preceding considerations are not important, and it is indeed felt beneficial to ensure that the radial flow is as high and turbulent as possible, and has a substantial upward or downward component to create large scale stirring within the volume of metal surrounding each gas injector.

It is most preferable and metallurgically advantageous in the present invention to carry out the gas treatment in a treatment zone consisting of one or more stages operated in series. This can be done in a modular fashion and it is possible, where space limitations or other considerations are important, to separate these stages along a metal-carrying trough, provided the total number of stages remain the same as would be used in a more compact configuration. It is also preferred that each stage consist of a gas injector as described above and be delimited from neighbouring stages. Each stage consists of a gas injection rotor as described above and is delimited from neighbouring stages by baffles or other devices designed to minimize the risk of backflow, or bypassing of metal between stages, and to minimize the risk of disturbances in one stage being carried over to adjacent stages.

The baffles can also incorporate the flow directing means described above which counter the tangential velocity component.

It should be understood that the treatment stage refers to the general part of the apparatus adjacent to a gas injector, and may be defined by baffles if they are present. The treatment segment, on the other hand is a portion of the container defined in the specific hydrodynamic terms required for the proper operation of the invention. It may be the same as the treatment stage in some cases.

The provision of plurality of treatment stages is (based on chemical principles) a more effective method for diffusion controlled reactions and removal of non-metallic solid particles for metal treatment. The plurality of rotary gas injectors within a directed metal flow as is created by the trough section operates (in chemical engineering terms) as a pseudo-plug flow reactor rather than a well-mixed reactor which is characteristic of deep box degassers.

It has been found that the effectiveness of the gas bubble shearing action, and hence the effectiveness at obtaining high gas holdup required to meet the object of the invention, increases as the power input intensity to the rotors in the treatment zone increases. When measured as the average power input per unit mass of metal contained within a treatment segment, and assuming that the net power available is typically 80% of installed (motor) power, typical treatment systems based on rotors operate in the range of power input densities of 1 to 2 watts/Kg of metal. The present invention is capable of operation at power input intensities in excess of 2 watts/Kg, and most frequently in excess of 4 watts/Kg, thus ensuring the smaller more stable bubble size required for effective treatment in small quantities of metal.

It should be appreciated that within the operating ranges of number, size and specific design of rotors, rotational speeds, positions relative to the trough and metal surface, metal flowrates and trough sizes and shapes there will be combinations within these ranges which give the desired treatment efficiency in the short times required.

As a result of this the apparatus is also compact and can be operated without the need for heaters and complex ancillary equipment such as hydraulic systems for raising and lowering vessels containing quantities of molten metal. As a result, the equipment normally occupies little space and is usually relatively inexpensive to manufacture and operate.

The requirements of fine bubbles, good bubble dispersion, and avoidance of deep metal vortices can be enhanced in certain instances by the use of fixed vanes located adjacent to the smooth faced rotor and substantially perpendicular to it. The fixed vanes serve to increase the shear in the vicinity of the rotor face, and also ensure that metal is directed radially away from the rotor face thus improving bubble dispersion capability (and avoiding bubble coalescence). The fixed vanes also totally eliminate any tendency for deep metal vortex formation. The rotor/fixed vane radial distance or gap is typically 1 to 25 mm (preferably 4 to 25 mm). When vanes are employed, generally at least two fixed vanes are required per rotor, and more preferably 4 to 12 are used. When fixed vanes are used, the requirements for fine bubbles and good dispersion conditions can be met at lower rotor speeds and in essentially non-moving metal. Thus the rotor plus fixed vane operation is effective at rotational speeds as low as 300 rpm and metal flows as low as zero Kg/min.

The lower operating speeds and the effective suppression of deep metal vortices permits a wider variety of rotor designs to be used without the generation of performance limiting surface disturbances.

DESCRIPTION OF THE PREFERRED EMBODIMENTS

Figure 1:
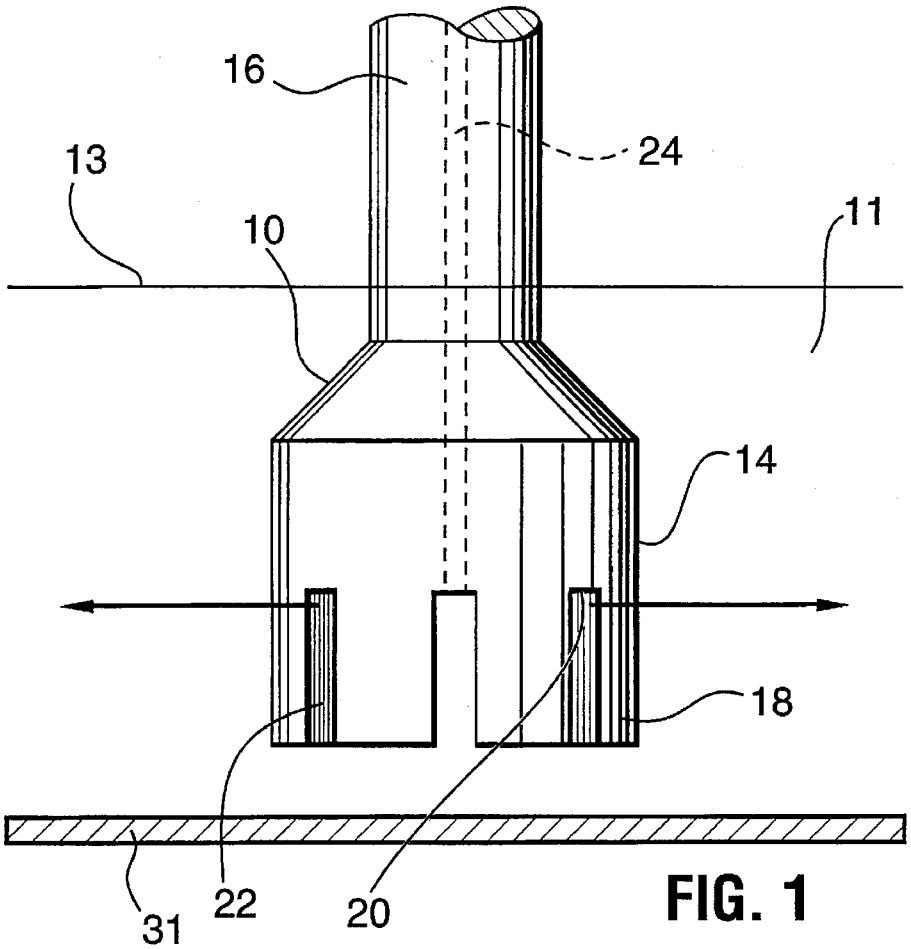
FIG. 1 is a side elevation of a first embodiment of the rotor of this invention.
Figure 2:
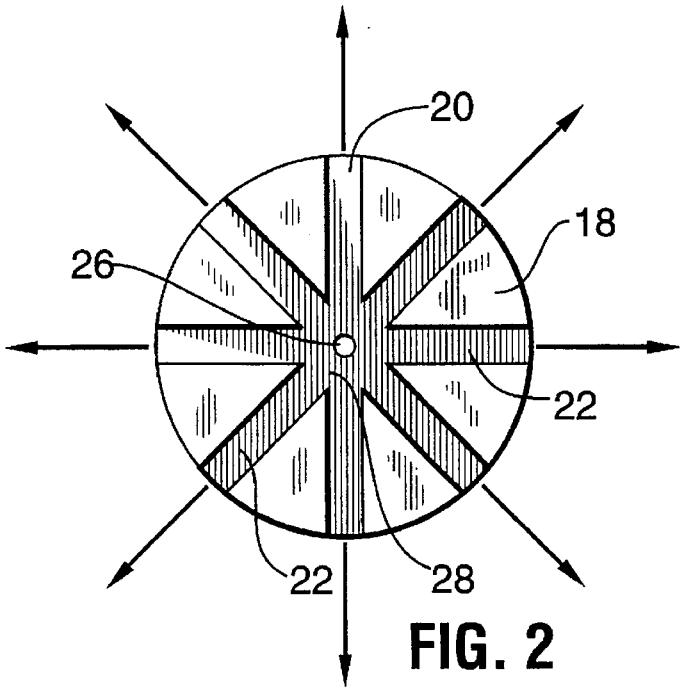
FIG. 2 is an underside plan view of the rotor of FIG. 1.

FIGS. 1 and 2 show a first embodiment of a rotary gas injector of this invention in a metal delivery trough. The injector has a smooth faced rotor body 10 submerged in a shallow trough, formed by opposed side walls (not visible) and a bottom wall 31, filled with molten metal 11 having an upper surface 13.

The rotor 10 is in the form of an upright cylinder 14 having a smooth outer face, mounted on a rotatable vertical shaft 16 of smaller diameter, with the cylinder portion having an arrangement of vanes extending downwardly from a lower surface 20, and the outer faces of the vanes forming continuous smooth downward extensions of the surface of cylinder 14. As can be seen most clearly from FIG. 2, the rotor vanes 18 are generally triangular in horizontal cross-section and extend radially inwardly from the outer surface. The vanes are arranged symmetrically around the periphery of the lower surface 20 in such a way as to define evenly spaced, diametrically-extending channels 22 between the vanes, which channels intersect to form a central space 28. An elongated axial bore 24 extends along the shaft 16, through the upright cylinder 14 and communicates with an opening 26 at the central portion of the surface 20 within the central space 28. This axial bore 24 is used to convey a treatment gas from a suitable source (not shown) to the opening or injection point 26 for injection into the molten metal.

The rotor 10 is immersed in the molten metal in the metal delivery trough to such a depth that at least the channels 22 are positioned beneath the metal surface and normally such that the cylindrical body is fully immersed, as shown. The rotor is then rotated about its shaft 16 at a suitably high speed to achieve the following effects. First of all, the rotation of the rotor causes molten metal to be drawn into the central space 28 between the rotor vanes 18 from below and then causes the metal to be ejected horizontally outwardly at high speed through the channels 22 in the direction of the arrows (FIGS. 1 and 2), thus forming generally radially moving streams. The speed of these radially moving streams depends on the number and shape of the vanes, the spacing between the vanes, the diameter of the cylinder and the rotational speed of the rotor. The treatment gas is injected into the molten metal through the opening 26 and is conveyed along the channels 22 in a co-current direction with the moving molten metal in the form of relatively large, but substantially discrete gas bubbles.

The surface 20 between the vanes at their upper ends closes the channels 22 at the top and constrains the gas bubbles and molten metal streams to move generally horizontally along the channels before the bubbles can move upwardly through the molten metal as a result of their buoyancy. Typically 4 to 8 vanes 18 are provided, and there are normally at least 3, but any number capable of producing the desired effect may be employed.

The rapidly rotating cylindrical rotor creates a high tangential velocity at the outer surface of the cylinder Because the outer surface of the cylinder is smooth and surface disturbances from the inwardly directed vanes are minimized, the tangential velocity is rapidly dissipated in the body of the metal in the metal delivery trough. Consequently a high tangential velocity gradient is created near the outer smooth surface of the rotor. The rapidly moving streams of molten metal and gas exit the channels 22 at the sides of the rotor 10 and encounter the region of high tangential velocity gradient. The resulting shearing forces break up the gas bubbles into finer gas bubbles which can then be dispersed into the molten metal 11 in the trough. The shearing forces and hence the bubble size depend on the diameter of the rotor and the rotational speed of the rotor. Because there are no projections on the smooth surface of the rotor, and the outer ends of the vanes present a relatively smooth aspect, the tangential velocity is rapidly dissipated without creating a deep metal vortex within the molten metal. A small vortex (not shown) associated with the rotation of the shaft 16 will of course still be present but does not cause any operational difficulties.

To facilitate the treatment of molten metal contained in shallow troughs or vessels such as metal delivery troughs, the rotor is preferably designed to inject the gas into the molten metal at a position as close to the bottom of the trough as possible. Consequently the rotor vanes 18 may be made as short as possible while still achieving the desired effect and the rotor is normally positioned as close to the bottom of the trough as possible, e.g. within about 0.5 cm. However in some troughs of non-rectangular cross-section, the trough walls at the bottom of the trough lie sufficiently close to the rotor that the radial metal flow generated by the rotor impinges on the wall and causes excessive splashing. In such cases an intermediate location for gas injection more widely separated from the bottom of the trough will be preferable.

The apparatus makes it possible to disperse small gas bubbles thoroughly and evenly throughout a molten metal held in a relatively shallow trough despite the use of a high speed rotation rotor since vortexing and surface splashing is effectively prevented. By correct combination of the diameter, number and dimensions of vanes and rotational speed, the dispersion of small gas bubbles is achieved without generating excessive outward metal flow that causes splashing when it reaches the sides of the metal delivery trough adjacent the rotor.

Figure 3:
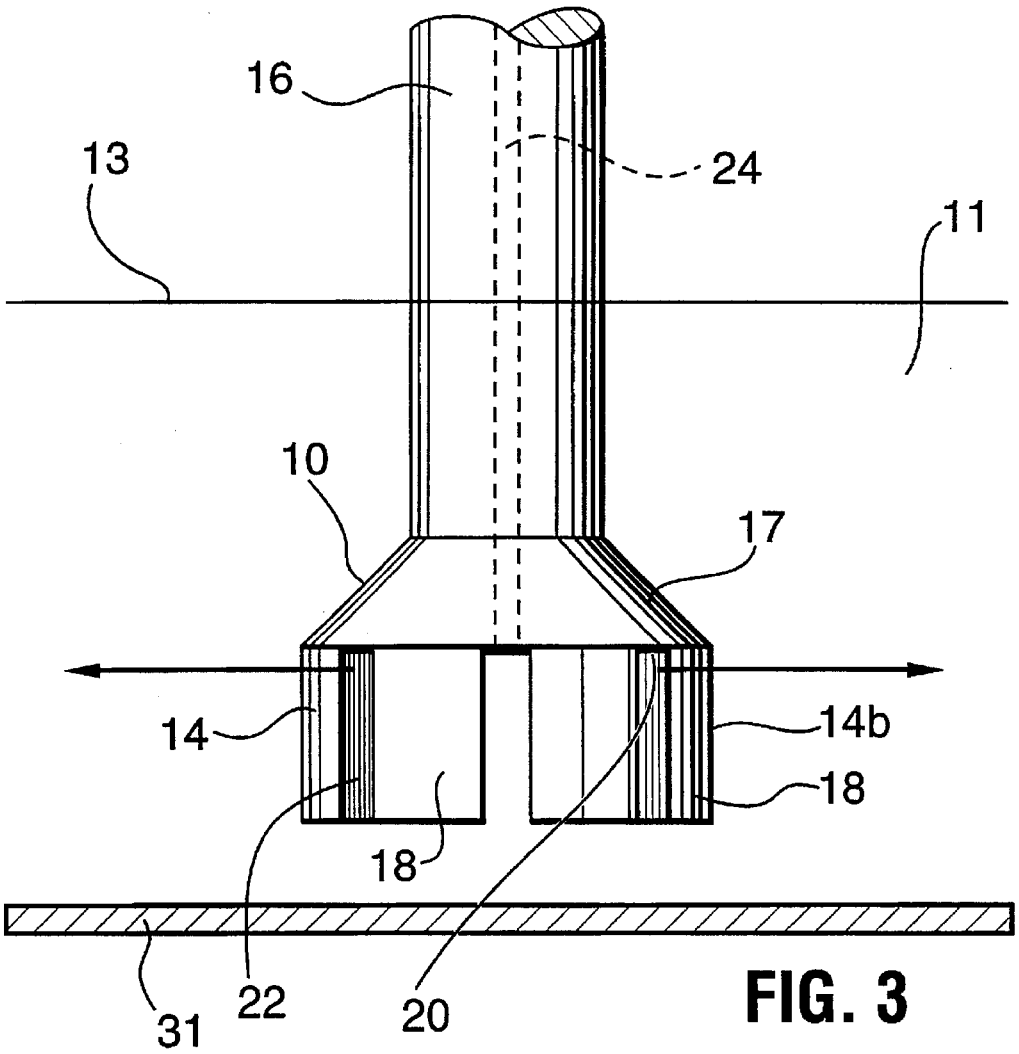
FIG. 3 is a side elevation of another embodiment of the rotor of this invention.

FIG. 3 shows a second preferred embodiment of the rotary gas injector of the invention. This injector represents a rotor having the same underneath plan view as the preceding rotor as illustrated in FIG. 2. However, the rotor 10 is in the form of a smooth surfaced upright truncated cone 17, mounted on a rotatable shaft 16 of smaller or equal diameter to the diameter of the upper surface of the cone, with the conical portion having an arrangement of vanes 18 extending downwardly from the lower surface 20, where the outer faces of the vanes form continuous smooth surfaces projecting downwardly from the intersection of the surface of the cone 17 with the vanes 18. By reducing the surface area of the surface of the cylinder 14 as described in FIG. 1 to the minimum required, the tendency to form a vortex is reduced over the embodiment of FIG. 1, and hence permits operations over a wider selection of conditions within the disclosed ranges.

Figure 4:
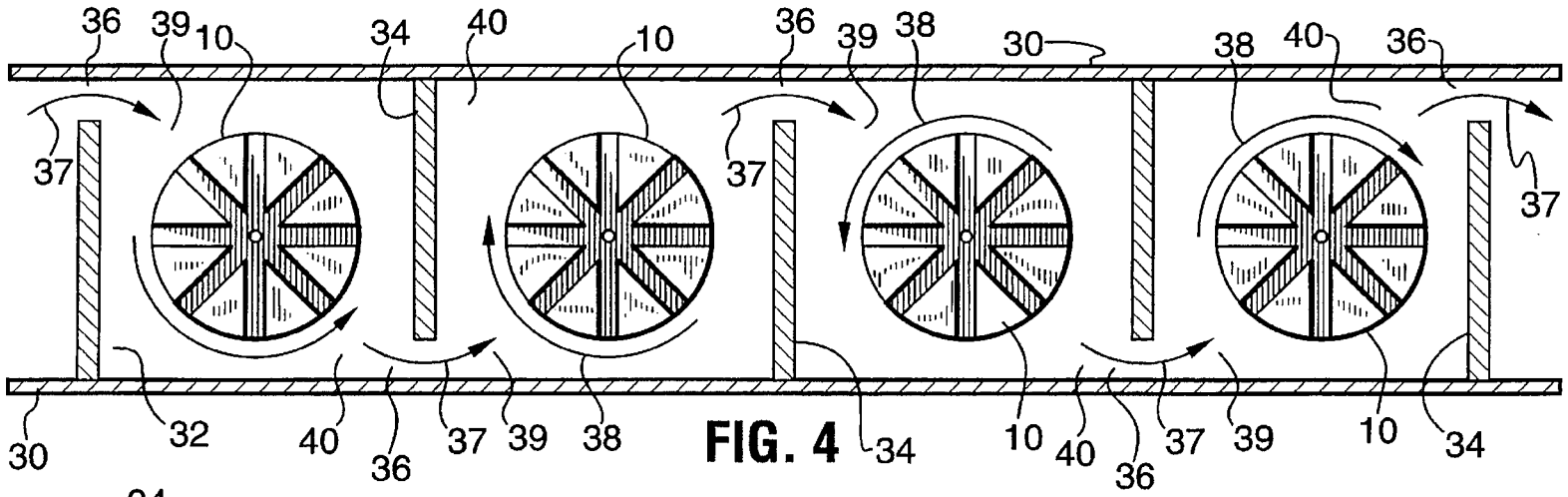
FIG. 4 is a representation view of a treatment zone consisting of a series of treatment stages containing a series of rotors and baffles.

FIG. 4 shows a treatment zone consisting of four treatment stages, where each stage incorporates a rotor 10, and each stage is separated from the next and from the adjacent metal delivery trough by baffles 34 which extend laterally across the trough section containing the treatment zone from sidewall 30 to sidewall except for a gap 36. The metal flows through the treatment zone in the pattern of flow shown by the arrows 37. The gaps 36 permit the metal to flow freely along the trough in a directed manner, but the baffles 34 prevent metal currents and disturbances from one treatment stage affecting the metal flow patterns in an adjacent treatment stage. Overall, a "plug flow" or "quasi-plug flow" is achieved, i.e. the overall movement of the metal is in one direction only along the trough, without backflow or bypassing of treatment stages, although highly localized reversed or eddy currents may be produced in the individual treatment stages.

The gaps 36 in adjacent baffles are arranged on opposite sides of the trough so that the principal molten metal flow is directed first into the regions 39 of the trough, and thence around the rotor into the regions 40 in such a way that overall the metal flows in an alternating pattern through the stages for maximum gas dispersion throughout the molten metal. The rotors rotate in the directions shown by the arrows 38, i.e. essentially counter to the direction of metal flow in regions 39 and 40 as established by the gaps 39 and thereby reduce further any tendency to form a deep vortex around the rapidly rotating rotors 10.

The illustrated equipment has good flow-through properties and low dynamic metal hold-up. The equipment thus creates only small metallostatic head loss over the length of the treatment zone, depending upon the size of the gaps 36 in the baffles 34.

Figure 5:
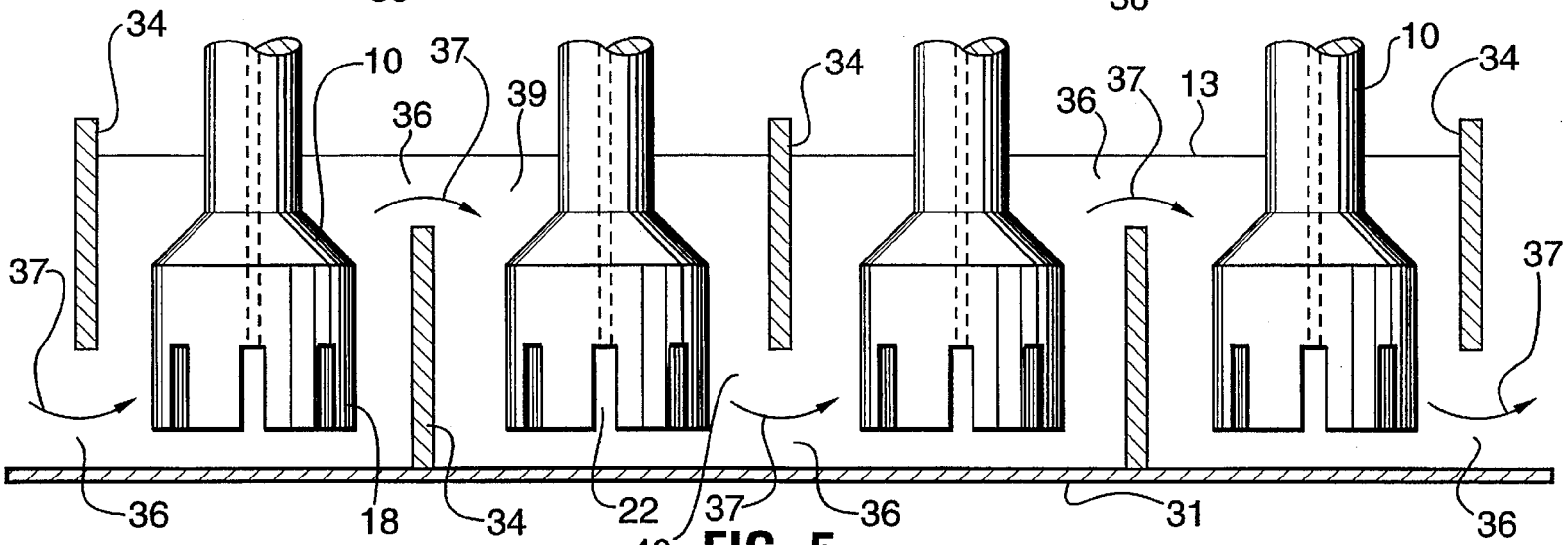
FIG. 5 is a longitudinal cross-sectional view on an arrangement as shown in FIG. 3 in slightly modified form.
Figure 6:
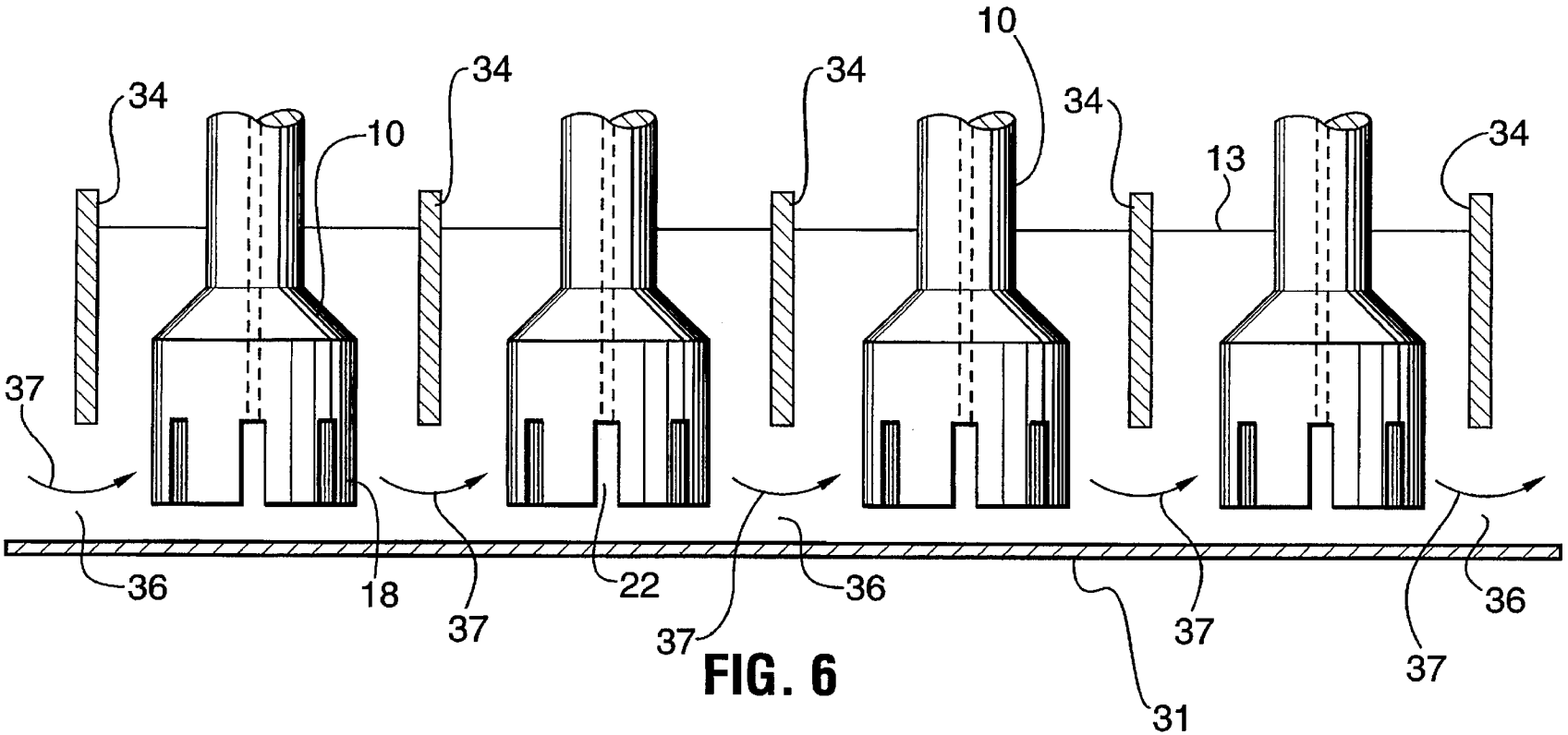
FIG. 6 is a further longitudinal cross-sectional view of an arrangement as shown in FIG. 3 in slightly modified form.

FIGS. 5 and 6 show arrangements similar to FIG. 4, except that the gaps in the baffles are arranged alternately top to bottom in the embodiment of FIG. 5 and bottom to bottom in the embodiment of FIG. 6. These arrangements are also suitable to effect thorough gas dispersion through the molten metal.

Figure 7:
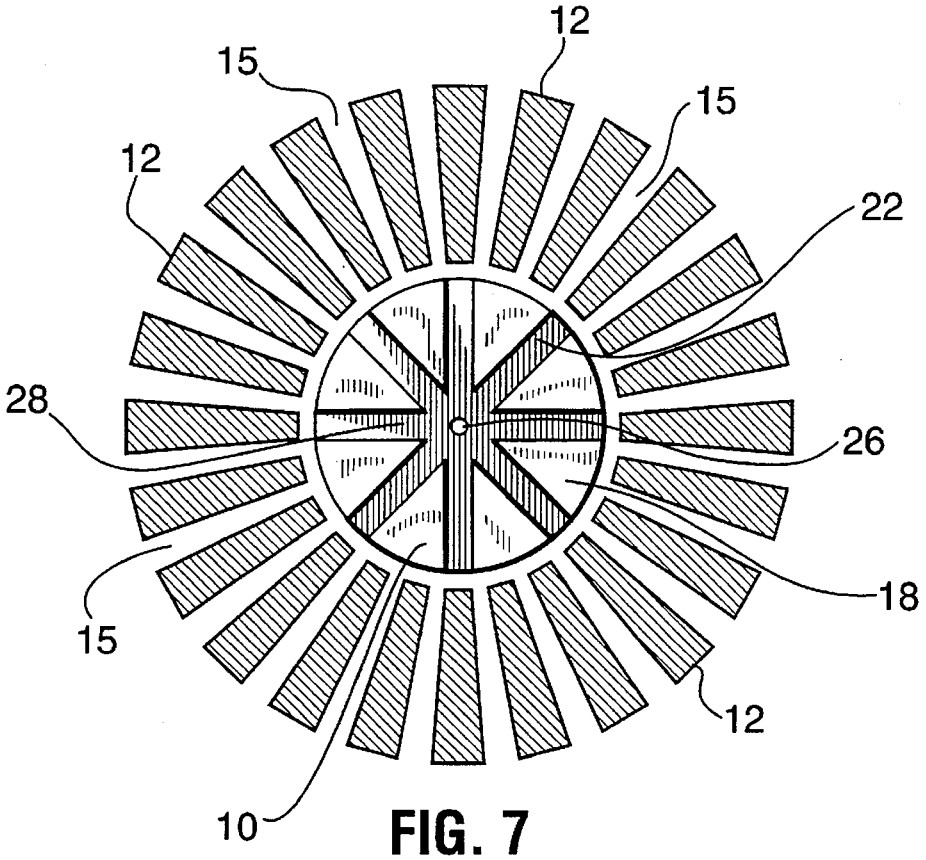
FIG. 7 is an underside plan view of a rotor operating with fixed vanes surrounding it.
Figure 8:
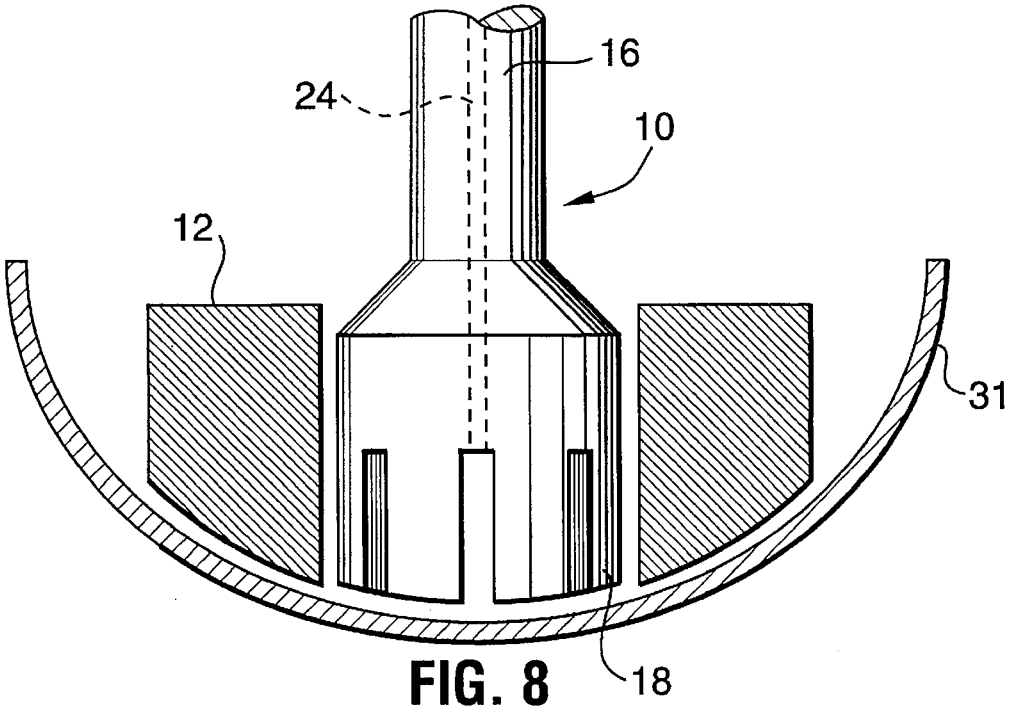
FIG. 8 is a side elevation of the rotor and vanes on FIG. 7 showing the assembly located in a metal delivery trough.

FIGS. 7 and 8 show an alternative embodiment where the rotor 10 has an adjacent set of evenly-spaced radially oriented stationary vertical vanes 12 surrounding the rotor symmetrically about the centre of the rotor and separated from each other by radial channels 15. As will be seen from FIG. 8, the lower surfaces of the rotor vanes 18 and of the stationary vanes 12 may be shaped to follow the contours of a non-rectangular trough 31, if necessary. In this embodiment, the tangential velocity generated at the surface of the rotor 10 is substantially stopped by the adjacent stationary vanes and the resulting shearing force acting on the metal is enhanced. As the gas-containing molten metal streams emerging from the channels 22 encounter the stationary vanes, the high shear is particularly effective at creating the fine gas bubbles required for degassing and permits the effect to be achieved at lower rotational speeds of the rotor. Furthermore, the stationary vanes act to channel the molten metal streams emerging from the channels 22 further along the channels 15 to enhance the radial movement of the metal and ensure complete dispersion of the gas bubbles within the metal in the treatment zone. Finally the presence of stationary vanes completely eliminates any tendency to deep metal vortex formation, even in very shallow metal troughs, as well as low flowrates or directed metal flow that is co-current rather than counter to the direction of rotation of the rotors. The use of stationary vanes also reduces the constraints on surface smoothness of the rotor.

For effective operation with the rotors of this invention, there should preferably be at least 4 stationary vanes per rotor and preferably more than 6. The distance between the rotor and the stationary vanes is preferably less than 25 mm and usually about 6 mm, and the smaller the distance the better, provided the rotor and vanes do not touch and thus damage each other.

Any of the embodiments which use stationary vanes may if desired also used in troughs containing baffles as described in FIGS. 4, 5 or 6.

Figure 9:
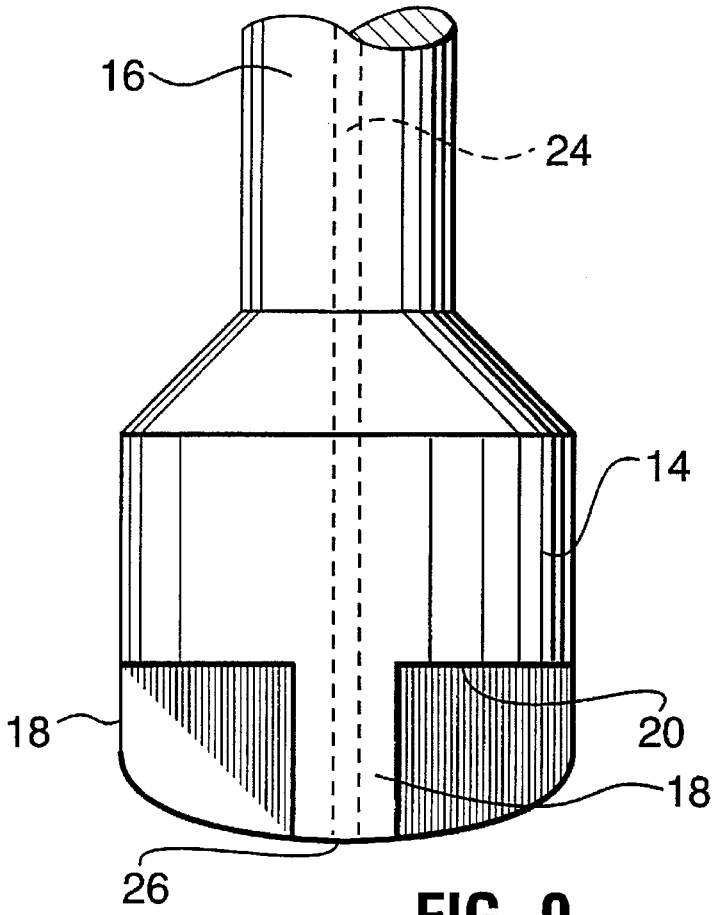
FIG. 9 is a side elevation of another embodiment of a rotor that is suitable for use with fixed vanes (not shown)
Figure 10:
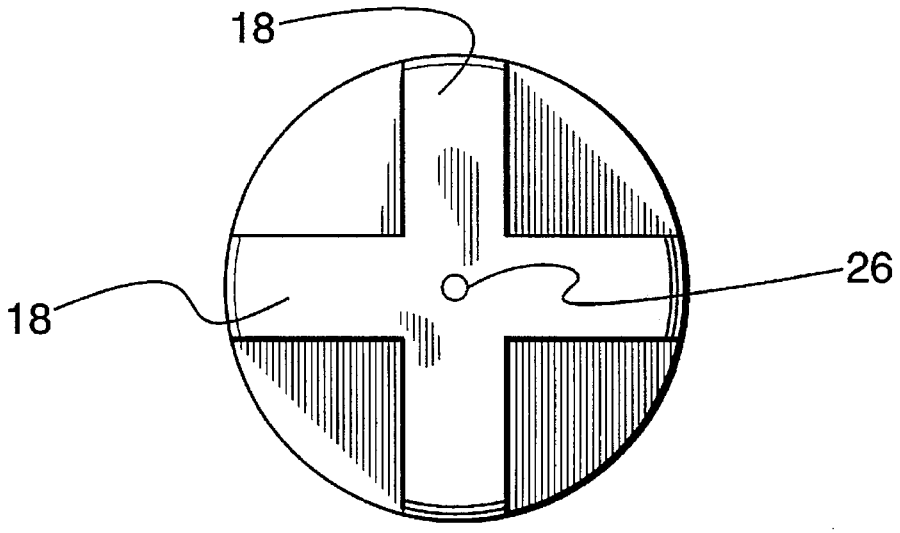
FIG. 10 is an underside plan view of the rotor of FIG. 9.

FIGS. 9 and 10 show a further embodiment of rotor that is intended for use with stationary vanes of the type shown in FIG. 7 and 8. FIGS. 9 and 10 show a rotor unit 10 in which two diametrical rotor vanes 18 intersect each other at the centre of the lower surface 20 of the cylinder 14. The axial gas passage extends through the intersecting portion of the vanes to the bottom of the rotor where the gas injection takes place through opening 26. This type of design in which the central area of the lower surface 20 is "closed" and where gas is injected below the upper edge of rotor vane opening 20 is less effective at radial "pumping"of the molten metal than the basic designs of FIGS. 1 and 2, but the manner of operation is basically the same. It falls outside the preferred open surface area requirement and gas injection point requirement for this invention, but nevertheless may be used with the stationary vanes as previously described since it has been noted above that the vanes permit a wider variety of rotors to be used.

Figure 11A:
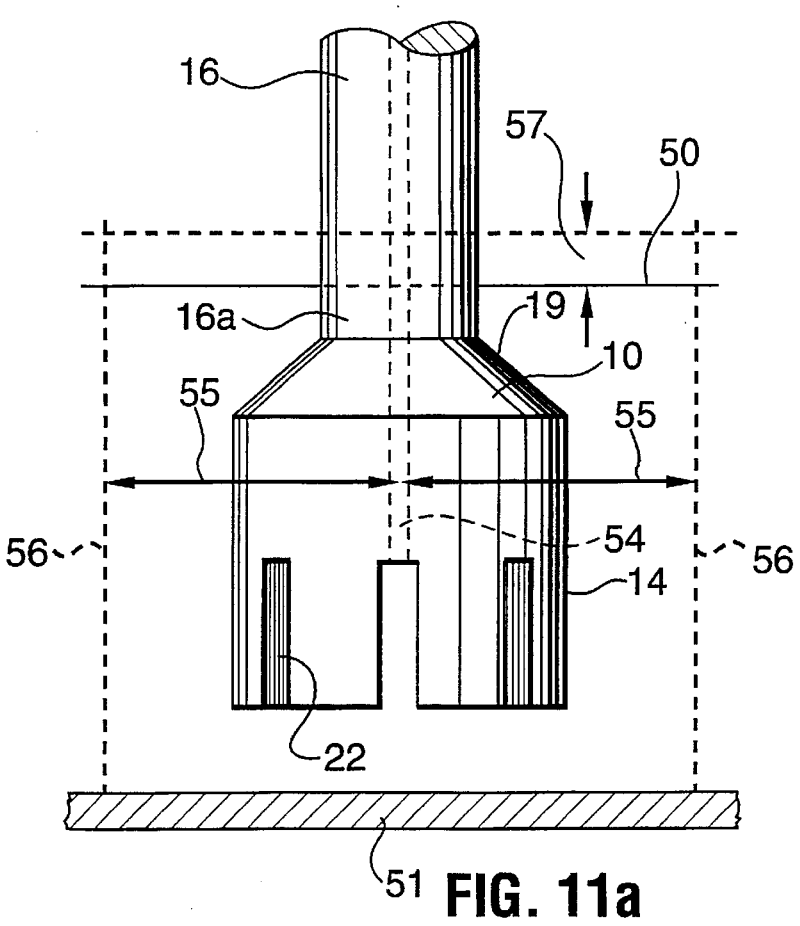
FIGS. 11(*a*) and 11(*b*) are, respectively, a side elevational view of an alternative rotor according to the invention and a plan view of the rotor positioned in a metal trough showing how certain dimensions are calculated.
Figure 11B:
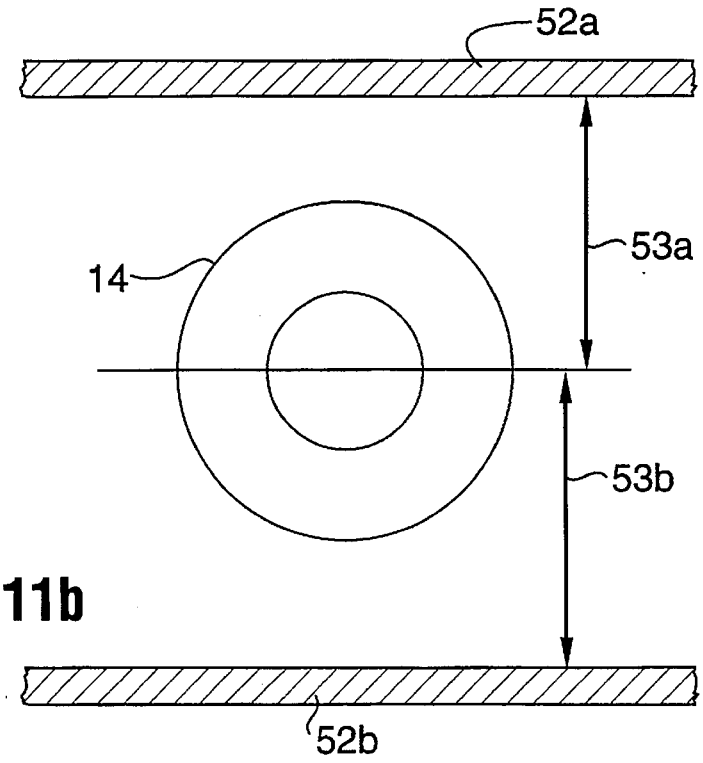
Figure 12A:
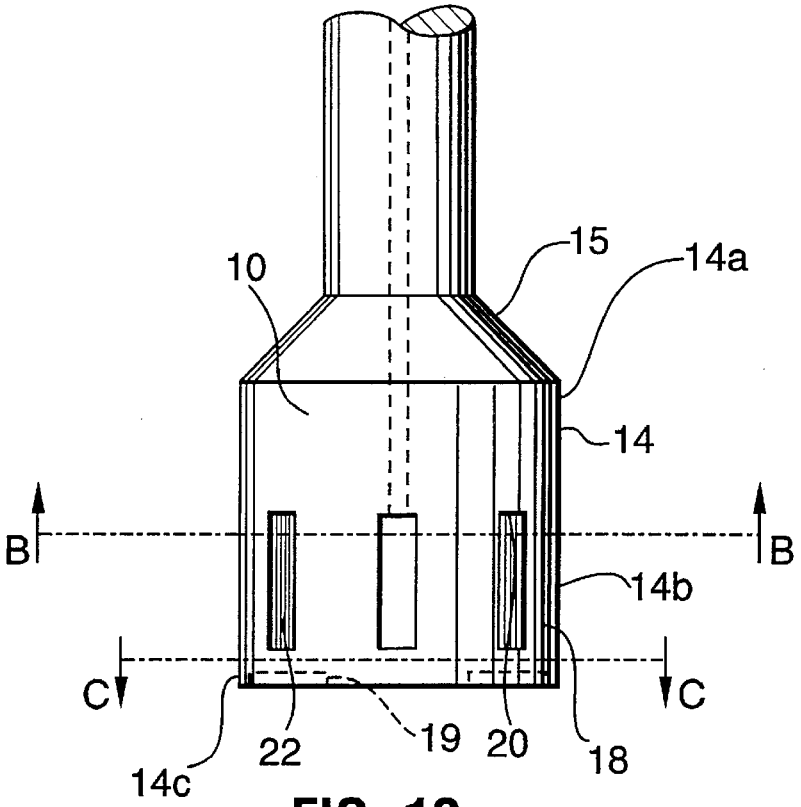
FIGS. 12(*a*), 12(*b*), 12(*c*) and 12(*d*) are, respectively, a side elevation of an alternative rotor according to the invention, cross-sectional plan views taken on lines B and C respectively of FIG. 12(*a*), and underneath plan view of the rotor.
Figure 12B:
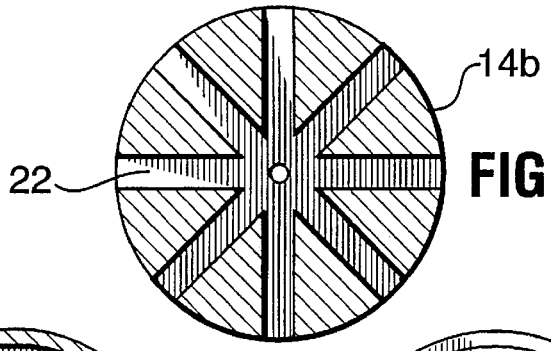
Figure 12C:
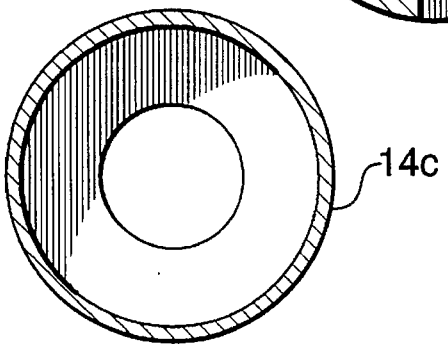
Figure 12D:
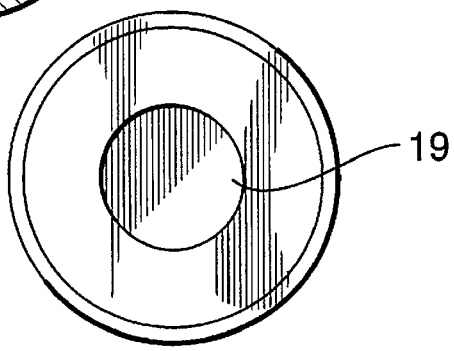

FIGS. 11(*a*) and 11(*b*) show various dimensions required to determine the amount of gas holdup created by a rotor. A rotor 10 and portion of a shaft 16*a* are determined to have a volume $V_g$ where the volume includes the volume of any channels 22 within the cylindrical surface 14. The central axis of the rotor is located at distances 53*a* and 53*b* from the sides 52*a* and 52*b* of the trough containing the rotor. A portion of the trough is described by vertical planes 56 lying equidistant upstream and downstream from the axis of the rotor, at a distance 55 is one-half the distance 53 where the distance 55 is the maximum of 53*a* and 53*b*. The volume of metal lying between the walls 52*a* and 52*b*, the bottom of the trough 51, the upper metal surface 50 and the two vertical planes 56 is referred to as $V_M$. The change 57 in $V_M$ resulting from injection of gas into the metal via the rotor is referred to as the gas holdup.

FIGS. 12(*a*), 12(*b*), 12(*c*) and 12(*d*) represent, respectively, an elevational view, two sectional plan views, and an underneath plan view of another embodiment of the rotor of this invention. The embodiment is similar to the embodiment of FIG. 1 except that the cylindrical body 14 has a lower extending piece 14c in the form of a cylindrical upward-facing cup with an outer surface exactly matching in diameter and curvature the surface of the downward facing vanes 18. The cup has a central opening 19 in the bottom surface. By varying the diameter of the opening 19, the effectiveness of metal pumping can be controlled, thus allowing the radial and horizontal flow to be controlled without altering the tangential velocity of the cylindrical surface required to shear the gas bubbles.

Figure 13:
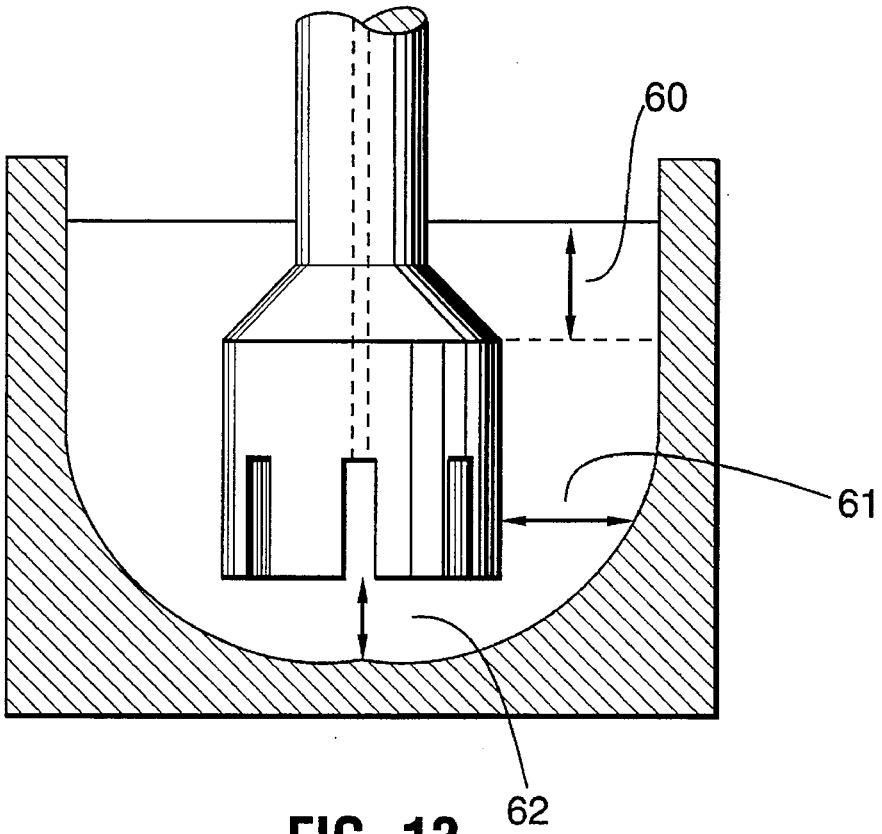
FIG. 13 is a cross-section of a trough containing a rotor shown in side elevation showing how various dimensions are defined.

FIG. 13 describes the dimensional constraints as disclosed in this specification. Distance 60 is the immersion of the upper edge of the side of the rotor below the metal surface and is preferably at least 3 cm. Distance 62 is the distance from the bottom of the rotor, measured from the centre of the rotor to the vertically adjacent bottom of the trough and is at least 0.5 cm.

Figure 14:
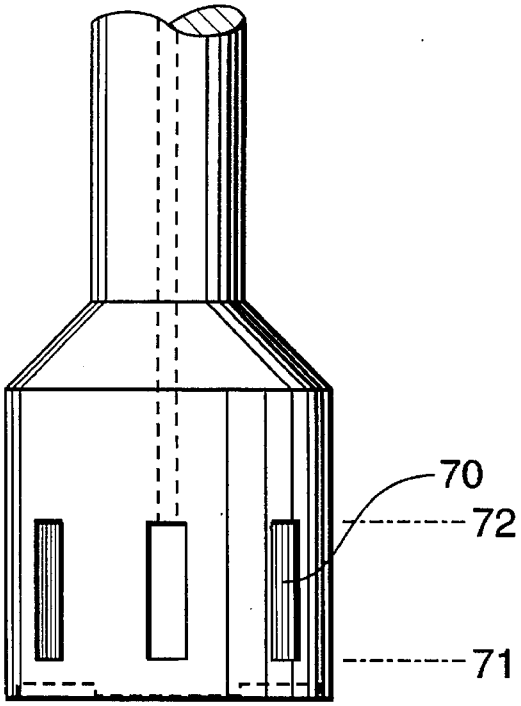
FIG. 14 is a side elevation of a further embodiment of a rotor according to the invention.

FIG. 14 shows the method of determining the open area of the openings in the side of the rotor. The openings 70 in the side of the rotor 14 on rotation describe a cylindrical surface lying between lines 71 and 72. If the area of this cylindrical surface is referred to as Ac, then the opening area ratio is defined as $A_o/A_c$ and should preferably not exceed 60%.

Figure 18:
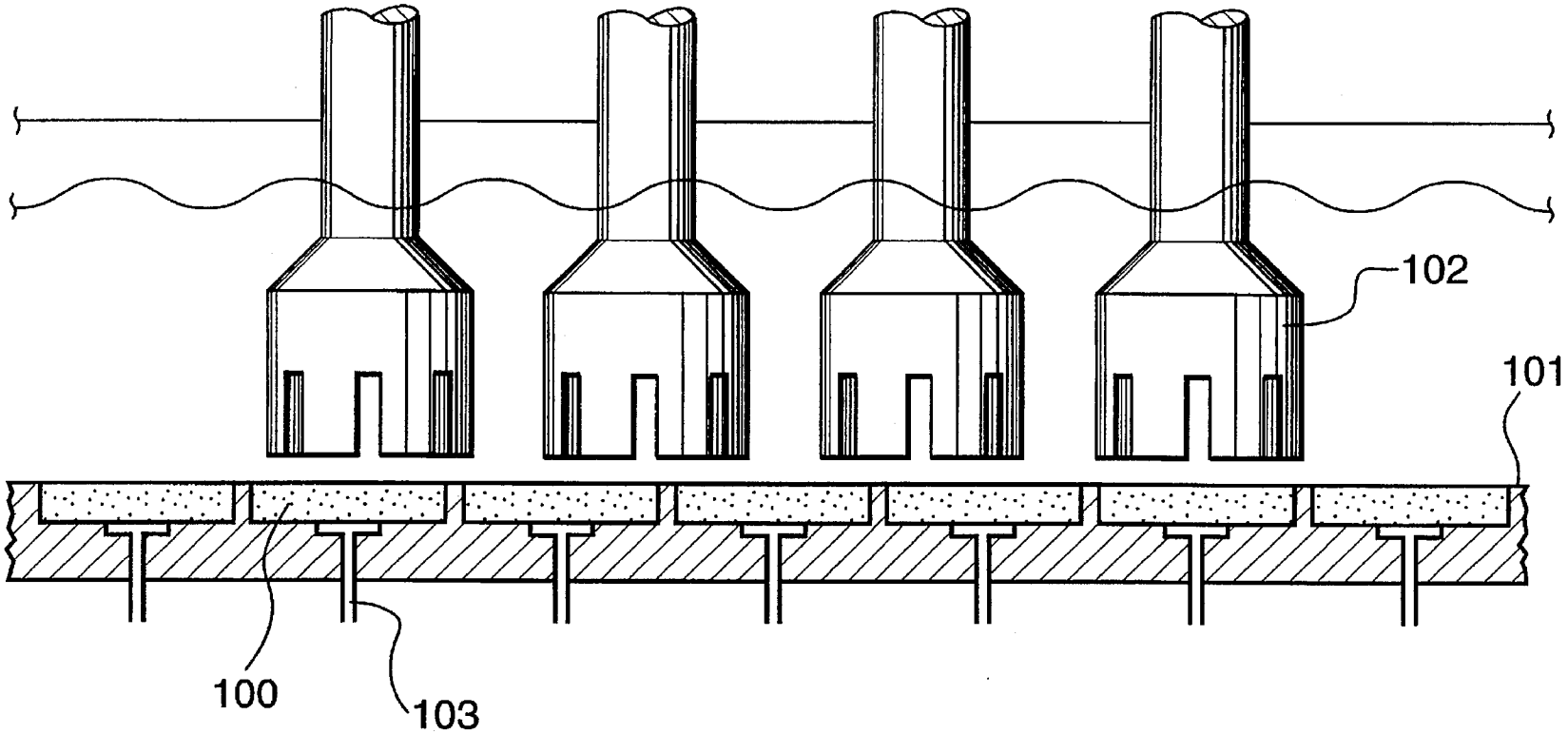
FIG. 18 is a longitudinal cross-sectional view of a treatment zone consisting of a series of treatment stages containing a series of rotary gas dispersers and associated fixed gas dispensers in the form of porous elements mounted in the bottom wall of a trough section.

FIG. 18 represents, in elevation, a treatment zone where gas is introduced via fixed gas dispensers 100 in the form of porous elements, mounted in the bottom wall 101 of a trough, separate from the gas dispersers 102, but adjacent to them. The gas dispersers are of the rotary type. The number of dispensers does not necessarily equal the number of dispersers, and the dispersers can form a continuous layer on the bottom of the trough if desired. The treatment gas is fed to the dispensers via orifices 103 in the bottom wall of the trough which are connected to a source of treatment gas (not shown). The porous elements and means to supply them with gas and to mounted then in the bottom wall of the trough can be of the type disclosed for example in U.S. Pat. No. 4,290,590 (Montgrain) or U.S. Pat. No. 4,714,494 (Eckert) incorporated here by reference.

Figure 19:
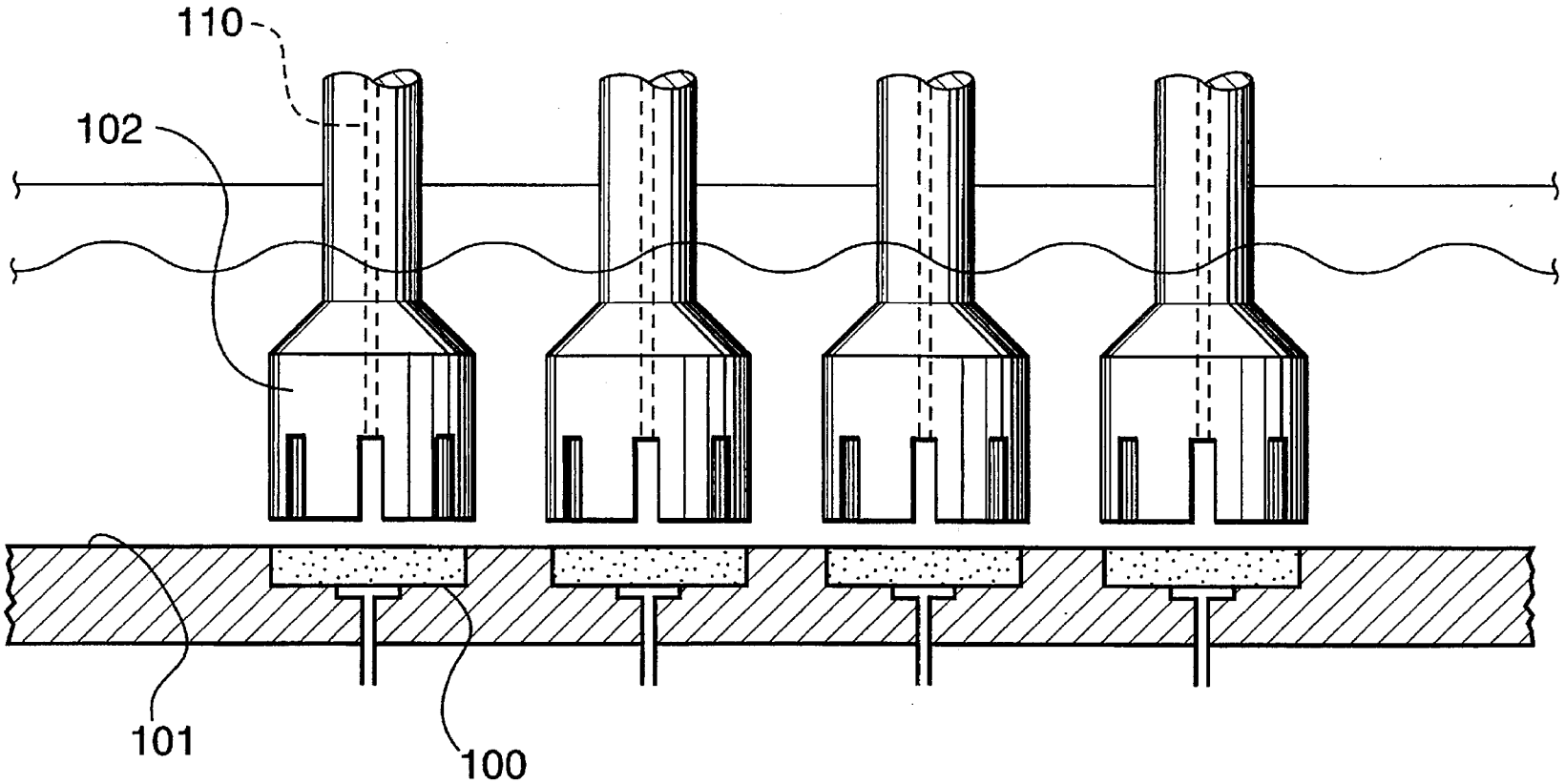
FIG. 19 is a further longitudinal cross-sectional view similar to FIG. 18, except that there is a single fixed gas dispenser associated with each rotary disperser, and the disperser also has provision for gas introduction.

FIG. 19 shows an alternative arrangement of gas dispensers 100 in the bottom wall 101 of the trough. In this arrangement there is one gas injector of the same type as in FIG. 15 located centrally under each gas disperser 102, to maximize the contact between the treatment gas and the dispersers and to avoid the escape of gas past the dispersers. Also shown in this figure are gas introduction passages 110 in each of the gas dispersers which permit the use of different treatment gas mixtures Within the same treatment zone. A preferred rotary form of the disperser would resemble that described in FIG. 1 for example. In this type of disperser, the metal is drawn up into the rotor and dispersed sideways (as was previously described), and placing the gas dispensers below each disperser will cause the gas bubbling up from such dispersers to be drawn into the disperser for effect breaking of the bubbles into finer bubbles and dispersion throughout the metal, in this case, along with gas delivered via the gas passage 110.

Figure 20:
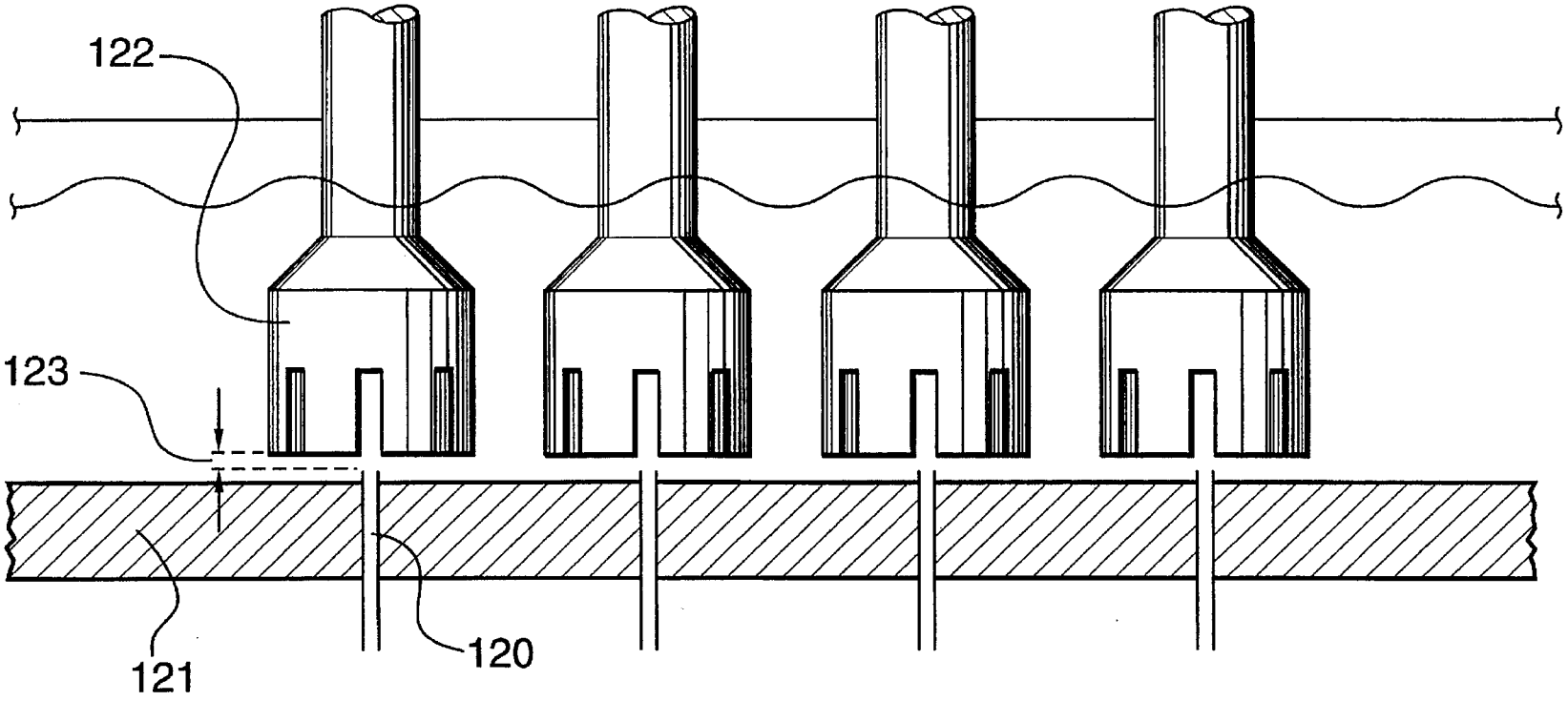
FIG. 20 is a further longitudinal cross-sectional view similar to FIG. 18, except that the fixed gas dispensers are in the form of tubular elements mounted in the bottom wall of the trough section.

FIG. 20 shows a third embodiment of fixed gas dispensers. The dispensers are in the form of tubes 120 mounted in the bottom wall 121 of the trough, and are located beneath rotary gas dispersers 122. By adjusting the distance 123 between the bottom of the gas dispersers and the adjacent gas dispenser it is possible to affect the degree of shearing of the bubbles and to alter their size if desired for metallurgical reasons. The tubes are preferably made of refractory or ceramic materials which can be readily joined to gas feeding manifolds or similar devices (not shown).

Figure 21:
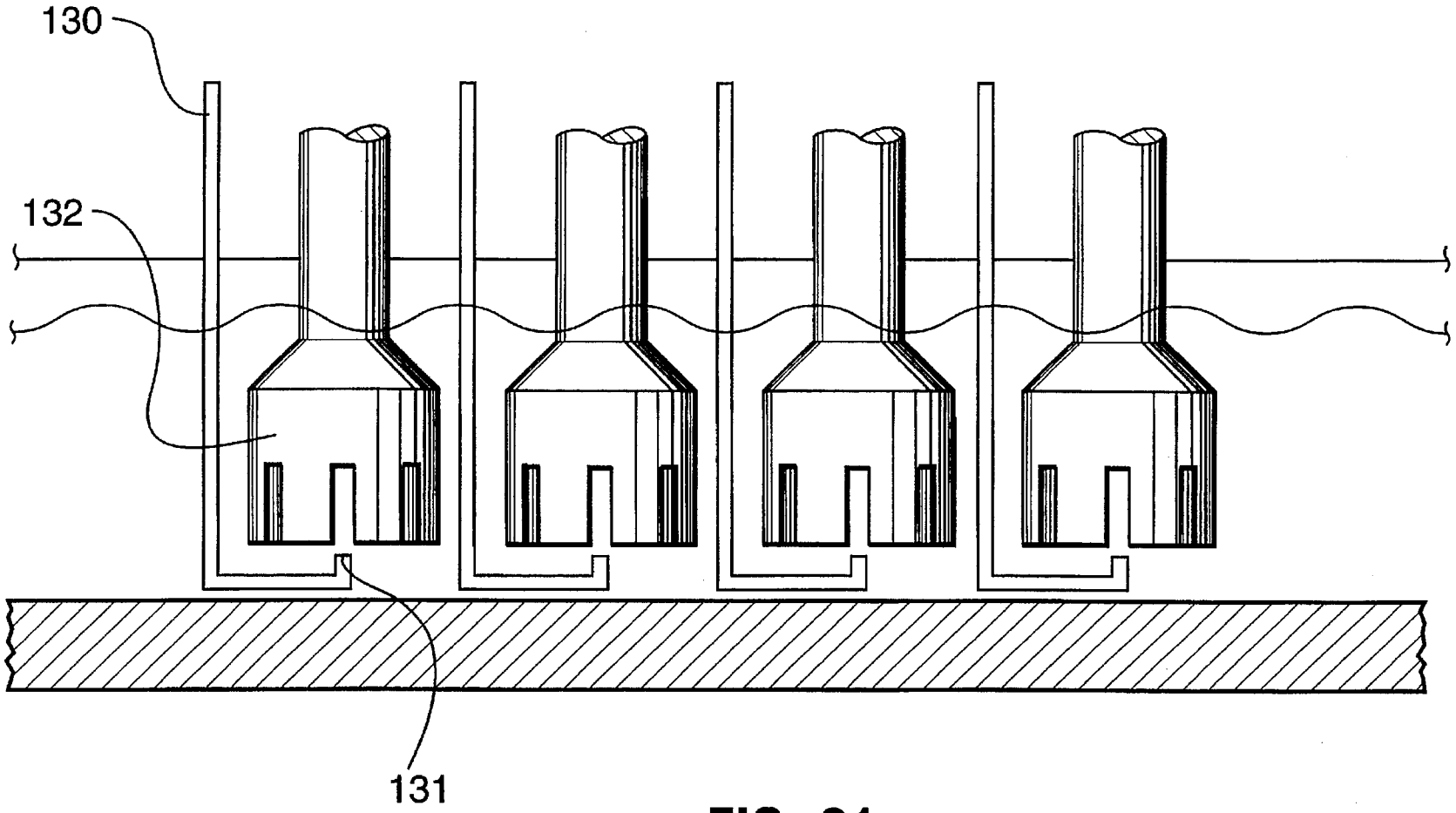
FIG. 21 is similar to FIG. 20 except that the tubular elements enter the trough from above the metal.

FIG. 21 shows a fourth embodiment of fixed gas dispensers. The dispensers are in the form of tubes 130 entering the treatment zone from above the metal and mounted above the metal (in a manner which is not shown), and terminating in an upwardly directed manner 131 underneath the gas dispersers 132. This embodiment is useful where there may be metal remaining in the trough between uses, since the gas dispensers as well as the dispersers can be removed.

In operation using any of the fixed injectors described in FIGS. 18 to 21, a gas flow is preferably maintained from a time before the injector comes in contact with molten metal to a time after it is no longer in contact with molten metal to ensure that the gas orifices do not become blocked.

Figure 17:
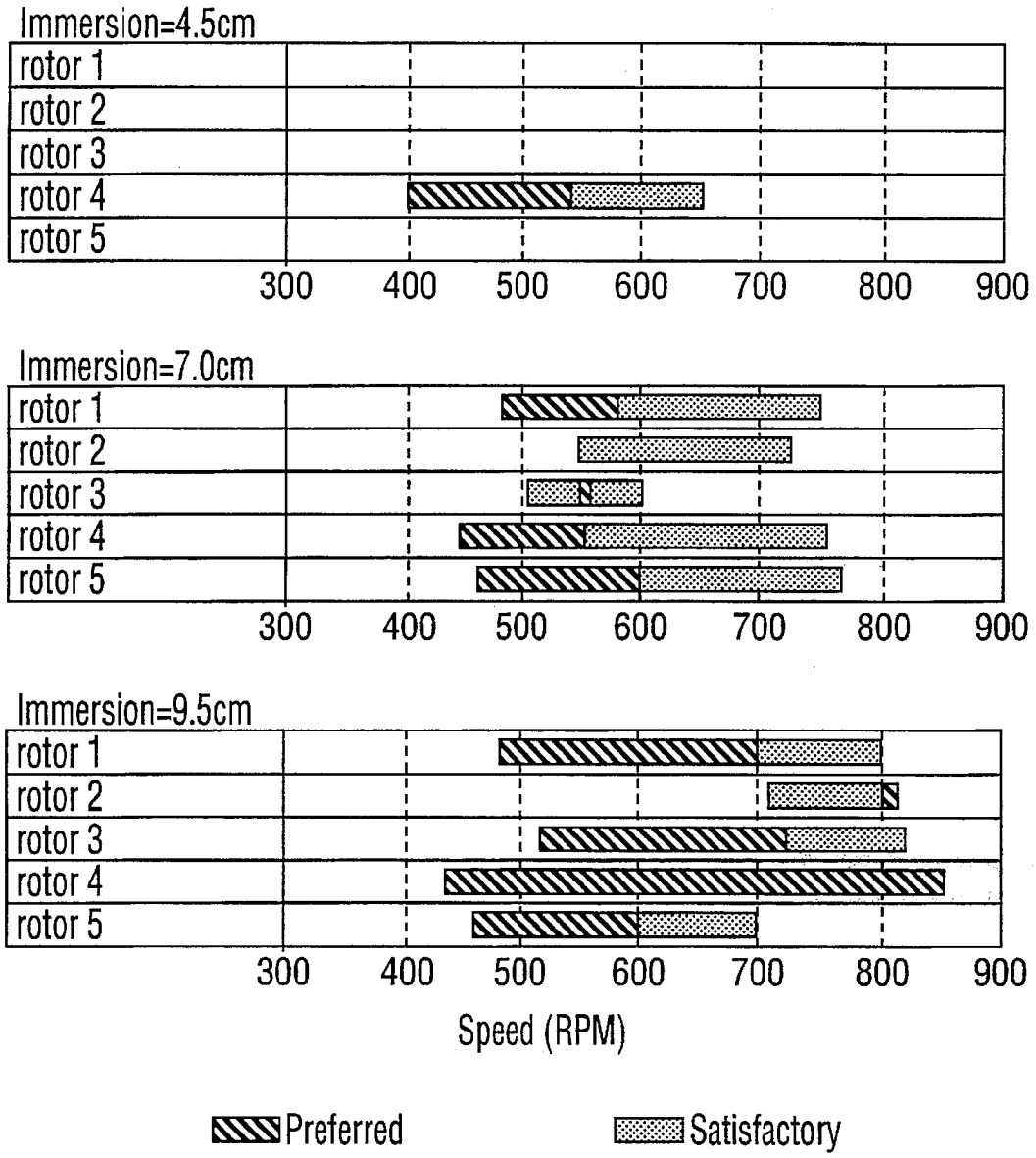
FIG. 17 is a plot showing the useful and preferred operating ranges for the rotary gas injectors of FIG. 16.

Any of the disperser shown in FIGS. 18, 20 or 21 can of course also be equipped with gas passages for additional treatment gas as described in FIG. 17.

As noted above, a particular advantage of the apparatus of the present invention is that it can be used in shallow troughs such as metal-delivery troughs and this can frequently be done without deepening or widening such troughs. In fact while the baffles 34 and the stationary vanes 12 (when required) may be fixed to the interior of the trough if desired, the assemblies of rotors, baffles and (if used) stationary vanes may alternately all be mounted on an elevating device capable of lowering the components into the trough or raising them out of the metal for maintenance (either of the treatment apparatus or the trough e.g. post-casting trough preparing or cleaning).

The trough lengths occupied by units of this kind are also quite short since utilization of gas is efficient because of the small bubble size and the thorough dispersion of the gas throughout the molten metal. The total volume of gas introduced is relatively small per unit volume of molten metal treated and so there is little cooling of the metal during treatment. There is therefore no need for the use of heaters associated with the treatment apparatus. A typical trough section required for a treatment zone with only one rotor would have a length to width ratio of from 1.0 to 2.0. Although a treatment zone containing a single rotor is possible, generally the treatment zone is divided into more than one treatment stages containing one rotor per treatment stage meeting the treatment segment volume limitations given above. The method and apparatus for metal treatment in a treatment zone can thereby be made modular so that more or less treatment stages and rotors can be used as required. Moreover the treatment stages which comprise the treatment zone need not be located adjacent to each other in a metal delivery trough if the design of the trough does not permit this. The usual number of rotors in a treatment zone is at least two and often as many as six or eight.

As indicated above, the metal treatment apparatus may be used for removing dissolved hydrogen, removing solid contaminants and removing alkali and alkaline earth components by reaction. Many metals may be treated, although the invention is particularly suited for the treatment of aluminum and its alloys and magnesium. The treatment gas may be a gas substantially inert to molten aluminum, its alloys and magnesium, such as argon, helium or nitrogen, or a reactive gas such as chlorine, or a mixture of inert and reactive gases. If chlorine is used for the treatment of magnesium-containing alloys, a liquid reaction product is formed which under the high shear generated in this treatment may be broken into an emulsion of very small droplets (typically 10 μm in diameter) which are easily entrained with the liquid metal downstream of the in-line treatment unit. This is undesirable due to the negative impact these inclusions have on specific aspects of the cast metal quality. The preferred reactive gas for this application is a mixture of chlorine and a fluoride-containing gas (e.g. $SF_6$) as described in U.S. Pat. No. 5,145,514 to Gariepy et al (the disclosure of which is incorporated herein by reference), which chemically converts the liquid inclusions into solid chlorides and fluorides which are more easily removed from the metal and are less chemically reactive than simple chloride inclusions and therefore have less impact on cast metal quality.

Where gas injection in the treatment zone is accomplished by separate gas dispensers and gas dispersers, the introduction of a treatment gas containing the reactive gas (such as chlorine) via the fixed dispensers adjacent the dispersers, with introduction of inert gas via the moving dispersers will permit the chlorine to be dispersed as larger bubbles, whilst the inert gas will be dispersed as very fine bubbles.

This permits the effective reaction rates of the different gases to be adjusted separately. In addition, the use of fixed gas dispensers for the reactive gases provide for easier maintenance.

EXAMPLE 1

Molten metal treatment was carried out in a treatment zone as described in FIGS. 1 through 3, except that a total of six rotary gas injectors was used and all rotary gas injectors rotated in the same direction. Each rotary gas injector was as described in FIGS. 1 and 2 with the following specific features. The outer diameter of each rotor was 0.1 m. Eight rotary vanes were used. The outer face of the rotor had openings which covered 39.8% of the corresponding area swept by these openings when the rotor was rotated. The vanes were in the form of truncated triangles, with the outer faces having the same contour as the outer face of the overall rotor and the inner ends terminating on a circle of diameter 0.0413 m. The vanes were spaced to provide passages of constant rectangular cross-section for channelling metal and gas bubbles. The rotors were operated at 800 rpm.

The treatment zone was contained within a section of refractory trough between a casting furnace and a casting machine and had a cross-sectional area of approximately 0.06 $m^2$ and a length of approximately 1.7 metres. The metal depth in the treatment zone varied from 0.24 metres at the start of the treatment zone to 0.22 metres at the end of the treatment zone. The rotors were immersed so that the point of injection of the gas into the metal stream was approximately 0.18 metres below the surface of the metal. The metal volume contained in each treatment segment, defined as the length of trough equal to the width at the surface of the metal times the vertical cross-sectional area, was approximately 0.021 $m^3$ for each of the rotary gas injectors.

The treatment zone was fed with metal at a rate of 416 Kg/min. A mixture of Ar and $Cl_2$ was used in the treatment, fed at a rate of 55 litres/min per rotary gas injector, corresponding to an average gas consumption of 0.8 litres/Kg.

Although all rotary gas injectors operated without the formation of deep metal vortices, it was noted that the normal vortices present as a result of the rotation of the shafts was reduced for those injectors where the metal flow was principally directed counter to the direction of the rotation.

When an aluminum-magnesium alloy (AA5182) was treated in the treatment zone as described, a hydrogen removal efficiency of between 55 and 58% was obtained, which compares favourably with prior art degassers used under the same conditions. The treatment time (average metal residence time in the treatment zone) was 34 seconds. A conventional deep box degasser operating under similar conditions required 350 seconds treatment time, and used approximately 0.5 $m^3$ of metal for each of the two rotors in the degasser.

EXAMPLE 2

Figure 15:
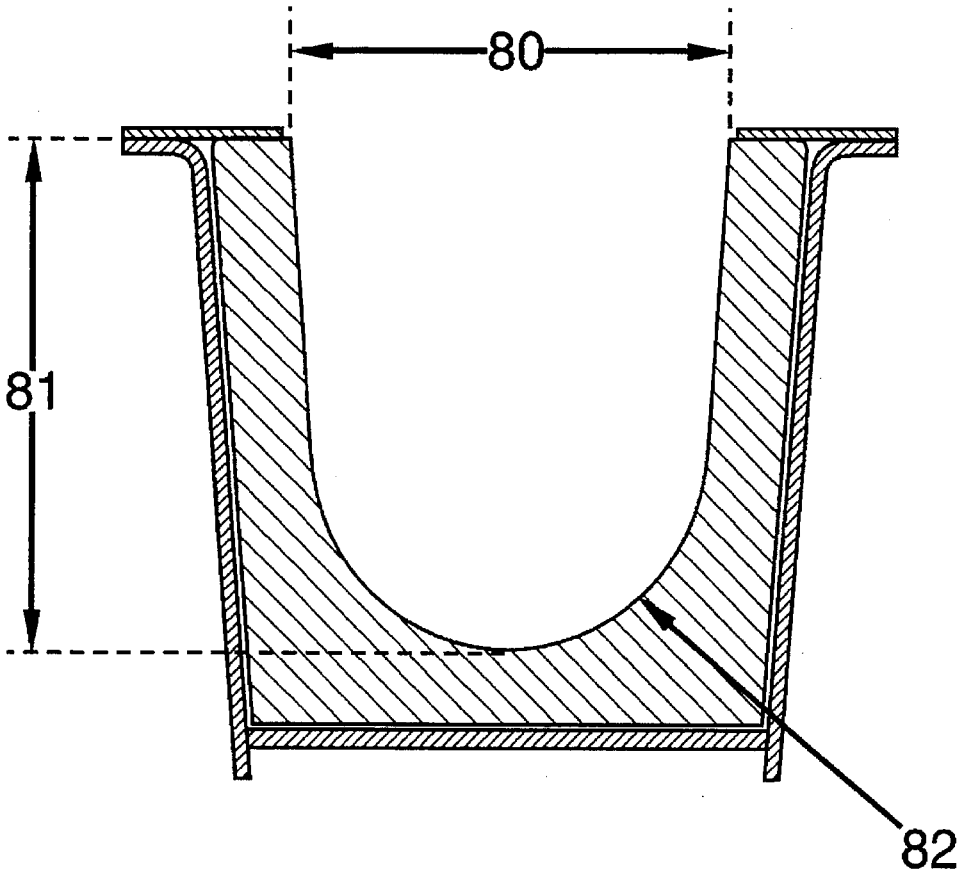
FIG. 15 is a cross section of a trough as used in this invention with the key dimensions labelled.
Figure 16:
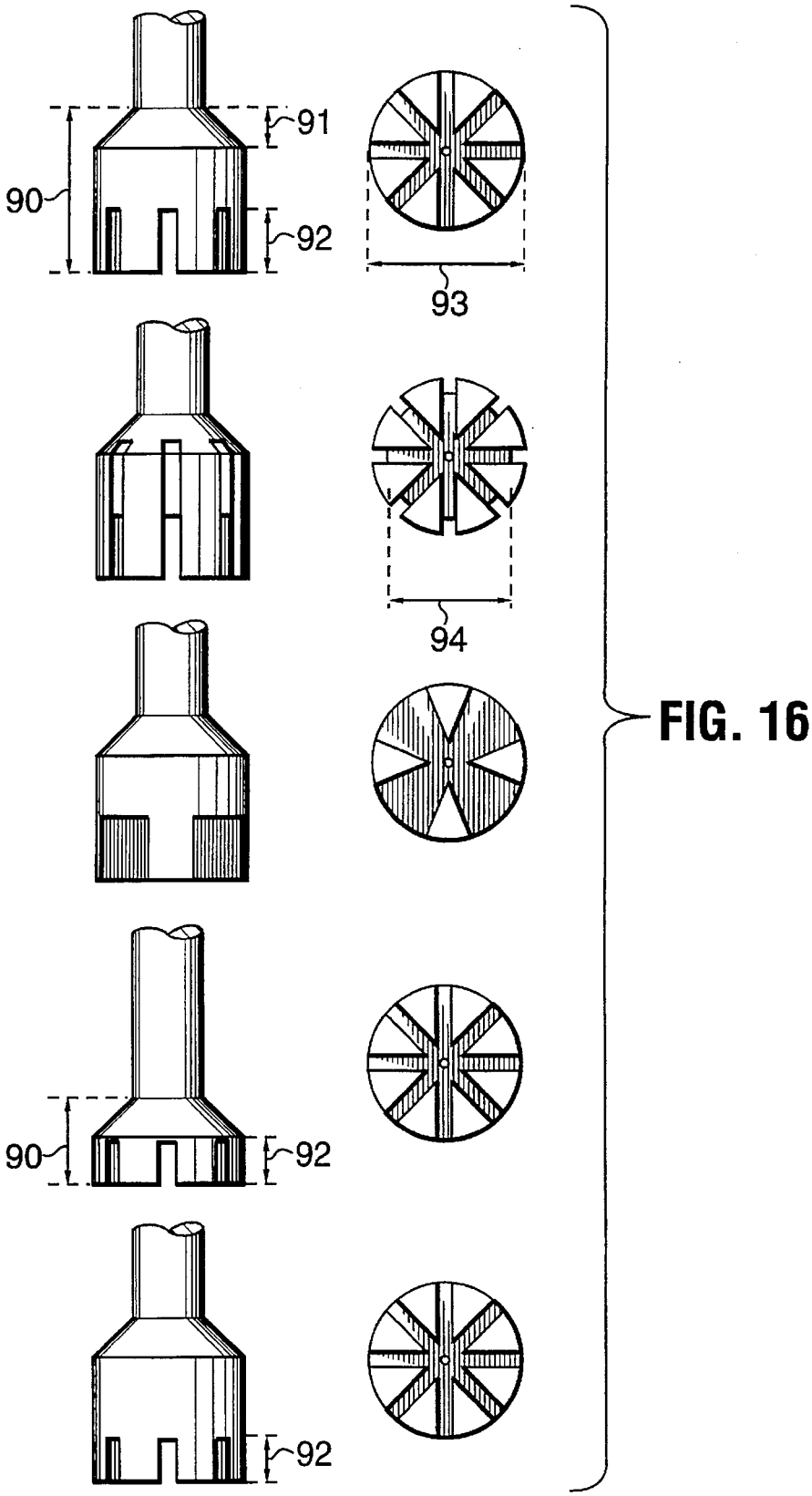
FIG. 16 shows side elevations and plan views of five rotary injectors as used in this invention with key dimensions labelled.

Metal treatment was carried out in aluminum alloy AA3004in a trough as illustrated in FIG. 15. The dimensions of the trough are given in Table 1. The treatment process was carried out using five different rotary gas injectors as shown in FIG. 16, with the critical rotor parameters given in Table 2. The metal depth in the trough was 8.76 inches.(222 mm), and the aluminum alloy flowrate was 450 kg/min. The performance of the metal treatment apparatus was determined in terms of its ability to effectively disperse gas throughout the treatment zone without excessive splashing. Excessive splashing not only creates unsafe operation, but contributes to excessive dross formation. The rotors were tested at three immersion depths and over a range of rotational speeds. No attempt was made to acquire data at rotational speeds above 850 rpm. FIG. 17 shows the operational ranges determined for each rotor type at different immersion levels. Rotors 1, 4 and 5 all represent rotors of the particularly of preferred embodiment of this invention. Rotor 2 does not have the "smooth top" of the preferred embodiment, and rotor 3 has an area ratio which exceeds the preferred value of 60%. The figure indicate that while all rotors can operate within the present invention, the preferred rotors (1, 4 and 5) provide the widest operating windows within the operating ranges of the degasser.

TABLE 1

| Dimensions of Trough (FIG. 15) | |
|---|---|
| Top opening (80) | 339 mm (13.4 inches) |
| Depth (81) | 381 mm (15.0 inches) |
| Bottom curvature (82) | 152.4 mm (6.0 inches) radius |

The bottom of the trough is in the shape of a full semi-circle.

TABLE 2

| Rotor parameters (FIG. 16) | | | | | |
|---|---|---|---|---|---|
| | Rotor Type (see FIG. 16) | | | | |
| Dimension | 1 | 2 | 3 | 4 | 5 |
| Overall height (90) | 5.0" 127 mm | 5.0" 127 mm | 5.0" 127 mm | 3.0" 76 mm | 5.0" 127 mm |
| Shoulder height (91) | 1.5" 38 mm | 1.5" 38 mm | 1.5" 38 mm | 1.5" 38 mm | 1.5" 38 mm |
| Vane height (92) | 2.0" 51 mm | 2.0" 51 mm | 2.0" 51 mm | 1.5" 38 mm | 1.5" 38 mm |
| Overall diameter (93) | 4.0" 102 mm | 4.0" 102 mm | 4.0" 102 mm | 4.0" 102 mm | 4.0" 102 mm |
| Shoulder diameter (94) | 4.0" 102 mm | 3.0" 76 mm | 4.0" 102 mm | 4.0" 102 mm | 4.0" 102 mm |
| Open area of vanes | 39.8% | 39.8% | 70.0% | 39.8% | 39.8% |

We claim:

1. A method of treating a molten metal with a treatment gas, comprising:

continuously introducing the molten metal into a container having a bottom wall and opposed side walls which form a section of a trough;

providing at least one mechanically moveable gas disperser within the metal in the container;

introducing a gas into the metal adjacent to said gas disperser in a part of said trough forming a treatment zone such that said gas is broken into smaller bubbles by said gas disperser and is dispersed through the treatment zone;

said trough section being such that said section exhibits a static to dynamic metal holdup of less than about 50%.

2. A method according to claim 1 wherein said gas is introduced via a fixed gas dispenser having a gas outlet below said gas disperser.

3. A method according to claim 1 wherein said trough section exhibits a static to dynamic metal hold up of less than 35%.

4. A method according to claim 1 wherein said trough section exhibits zero static to dynamic metal holdup.

5. A method according to claim 1 wherein additional treatment gas is introduced via said gas disperser.

6. A method according to claim 5 wherein the said treatment gas and said additional treatment gas consists of different compositions.

7. A method according to claim 6 wherein one of said compositions includes a reactive gas.

8. A method according to claim 7 wherein the said reactive gas forms part of the said treatment gas.

9. A method according to claim 7 wherein the said reactive gas is chlorine.

10. A method according to claim 1 wherein the said treatment gas is entrained in the form of bubbles in said molten metal before said treatment gas and molten metal come in contact with said mechanically movable gas disperser.

* * * * *